US011391135B1

(12) United States Patent
Xia et al.

(10) Patent No.: US 11,391,135 B1
(45) Date of Patent: Jul. 19, 2022

(54) FRACTURING A SUBSURFACE FORMATION BASED ON THE REQUIRED BREAKDOWN PRESSURE

(71) Applicant: Saudi Arabian Oil Company, Dhahran (SA)

(72) Inventors: Kaiming Xia, Dhahran (SA); Tariq Mahmood, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 81 days.

(21) Appl. No.: 17/140,252

(22) Filed: Jan. 4, 2021

(51) Int. Cl.
*E21B 43/26* (2006.01)

(52) U.S. Cl.
CPC ..... *E21B 43/26* (2013.01); *E21B 2200/20* (2020.05)

(58) Field of Classification Search
CPC ..... E21B 43/26; E21B 2200/20
See application file for complete search history.

(56) References Cited

U.S. PATENT DOCUMENTS

| | | | |
|---|---|---|---|
| 6,724,687 | B1 | 4/2004 | Stephenson et al. |
| 7,073,578 | B2 | 7/2006 | Vinegar et al. |
| 7,121,342 | B2 | 10/2006 | Vinegar et al. |
| 7,360,588 | B2 | 4/2008 | Vinegar et al. |
| 7,890,307 | B2 | 2/2011 | Geehan et al. |
| 7,942,203 | B2 | 5/2011 | Vinegar et al. |
| 8,579,031 | B2 | 11/2013 | Vinegar |
| 2016/0045841 | A1 | 2/2016 | Kaplan et al. |

(Continued)

FOREIGN PATENT DOCUMENTS

| | | |
|---|---|---|
| AU | 2013206713 | 7/2013 |
| CA | 2884071 | 3/2014 |
| CN | 104459775 | 2/2017 |

(Continued)

OTHER PUBLICATIONS

Kurdi, Mohammed, & Hamid Roshan (2018). "A New Computational Model to Predict Breakdown Pressures in Cased and Perforated Wells in Unconventional Reservoirs." ASEG Extended Abstracts, 2018:1, 1-9, DOI: 10.1071/ASEG2018abT4_3C. Accessed May 17, 2022 (Year: 2018).*

(Continued)

*Primary Examiner* — Crystal J. Lee
(74) *Attorney, Agent, or Firm* — Fish & Richardson P.C.

(57) ABSTRACT

Some methods of hydraulic fracturing of a subsurface formation include using a three-dimensional finite element model to simulate a deviated well with a wellbore casing, a cement adjacent to the wellbore casing, and a perforation cluster with at least two perforations. The FEM is applied (or solved) to determine a breakdown pressure of the deviated well based on an amount of tensile damage of the perforation cluster induced by an applied pressure representing injected hydraulic fluid. The FEM accounts for the 3D complex configuration of wellbore and perforation cluster. A deviated well is drilled and completed with a wellbore casing size, tubing size, wellhead, and hydraulic fracturing pump schedule selected at least in part based on the determined breakdown pressure before hydraulic fluid is injected into the deviated well at an injection pressure, which represents the required breakdown pressure to cause hydraulic fracturing of the rock of the subsurface formation.

20 Claims, 18 Drawing Sheets

(56) References Cited

U.S. PATENT DOCUMENTS

2017/0169137 A1 6/2017 Shen et al.
2018/0293789 A1* 10/2018 Shen ..... E21B 47/00

FOREIGN PATENT DOCUMENTS

| | | |
|---|---|---|
| CN | 109711595 | 5/2019 |
| KR | 101620506 | 5/2016 |
| WO | 2016100762 | 6/2016 |

OTHER PUBLICATIONS

U.S. Appl. No. 17/075,342, filed Oct. 20, 2020, Xia et al.
U.S. Appl. No. 17/168,734, filed Feb. 5, 2021, Xia et al.
Abaqus, "Concreate Damaged Plasticity" ABAQUS Online Manual, 2019, 14 pages.
Alekseenko et al., "3-D modeling of fracture initiation from perforated non-cemented wellbore" SPE 151585. The Proceeding of The SPE Hydraulic Fracturing Technology Conference held in The Woodlands, Texas, USA, Feb. 2012, 12 pages.
El-Rabaa et al., "New perforation pressure loss correlations for limited entry fracturing treatments" SPR-38373, The Proceedings of the SPE Rocky Mountain Regional Meeting. Casper, Wyoming, May 18-21, 1997, 9 pages.
Haimson et al., "Initiation and extension of hydraulic fractures in rock" Society of Petroleum Engineers. V.7, 1967, 310-318, 9 pages.
Hossain et al., "Hydraulic fracture initiation and propagation: roles of wellbore trajectory" Perforation and stress reginme. J. Pet. Sci. & Eng. vol. 27, 2000, 129-149, 21 pages.
Hubbert et al., "Mechanics of hydraulic fracturing" Petroleum Transaction, AIME. V.210, 1957, 153-168, 16 pages.
Kurdi et al., "A New Computational Model to Predict Breakdown Pressures in Cased and Perforated Wells in Unconventional Reservoirs" ASEG Extended Abstracts, 2018, 10 pages.
Lubliner, "A Plastic-Damage Model for Concrete" International Journal of Solids and Structures, vol. 25, No. 3, 1989, 28 pages.
Michael, "Orientation of hydraulic fracture initiation from perforated horizontal wellbore" SPE-199766-STU. The SPE Annual Technical Conference and Exhibition held in Calgary, Canada, Oct. 2019, 23 pages.
Shi et al., "An analytical solution to stress state of casing-cement sheath-formation system with the consideration of its initial loaded state and wellbore temperature variation." International Journal of Emerging Technology and Advanced Engineering 5.1, 2015, 59-65, 8 pages.
Waters et al., "The impact of geomechanics and perforations on hydraulic fracture initiation and complexity in horizontal well completions" SPE-181684-MS. The Proceedings of the SPE Annual Technical Conference and Exhibition held in Dubai, UAE, Sep. 26-28, 2016, 36 pages.
Weng et al., "Analytical model for predicting fracture initiation pressure from a cased and perforated wellbore" SPE-191462-18IHFT-MS, The Proceedingof the SPE International Hydraulic Fracturing Technology Conference and Exhibition, Muscat, Oman, Oct. 16-18, 2018, 21 pages.
Fatahi et al., "Numerical simulation for the determination of hydraulic fracture initiation and breakdown pressure using distinct element method." Journal of Natural Gas Science and Engineering 33, Jul. 2016, 1219-1232, 22 pages.
Gao et al., "New damage evolution model of rock material." Applied Mathematical Modelling 86, Oct. 2020, 207-224, 18 pages.
Jin et al., "Breakdown pressure determination—a fracture mechanics approach." SPE Annual Technical Conference and Exhibition, OnePetro, Sep. 2013, 18 pages.
Li et al., "A statistical meso-damage mechanical method for modeling trans-scale progressive failure process of rock." International Journal of Rock Mechanics and Mining Sciences 74, Feb. 2015, 133-150, 18 pages.
Liu et al., "The impact of oriented perforations on fracture propagation and complexity in hydraulic fracturing," Processes 6.11, 213, Nov. 2018, 19 pages.
Nguyen et al., "A cohesive damage-plasticity model for DEM and its application for numerical investigation of soft rock fracture properties." International Journal of Plasticity 98, Nov. 2017, 175-196, 22 pages.
Sampath et al., "Theoretical overview of hydraulic fracturing breakdown pressure." Journal of Natural Gas Science and Engineering 58, Oct. 2018, 251-265, 57 pages.
Shan et al., "A new finite element method to predict the fracture initiation pressure." Journal of Natural Gas Science and Engineering 43, Jul. 2017, 58-68, 19 pages.
Shen, "Modeling fractures with continuum damage and its numerical application to stimulation estimates." 46th US Rock Mechanics/Geomechanics Symposium, OnePetro, Jun. 2012, 7 pages.
Tang et al., "Damage analysis and numerical simulation for failure process of a reinforced concrete arch structure." Computers & structures 83.31-32, Dec. 2005, 2609-2631, 23 pages.
Wen et al., "Energy analysis of the deformation and failure process of sandstone and damage constitutive model." KSCE Journal of Civil Engineering 23.2, Feb. 2019, 513-524, 12 pages.
PCT International Search Report and Written Opinion in International Appln. No. PCT/US2021/065128, dated May 6, 2022, 15 pages.
PCT International Search Report and Written Opinion in International Appln. No. PCT/US2021/055543, dated Feb. 10, 2022, 16 pages.
Zeng et al., "Perforation Orientation Optimization to Reduce the Fracture Initiation Pressure of a Deviated Cased Hole" Journal of Petroleum Science and Engineering, vol. 177, Jun. 2019, 829-840, 12 pages.

* cited by examiner

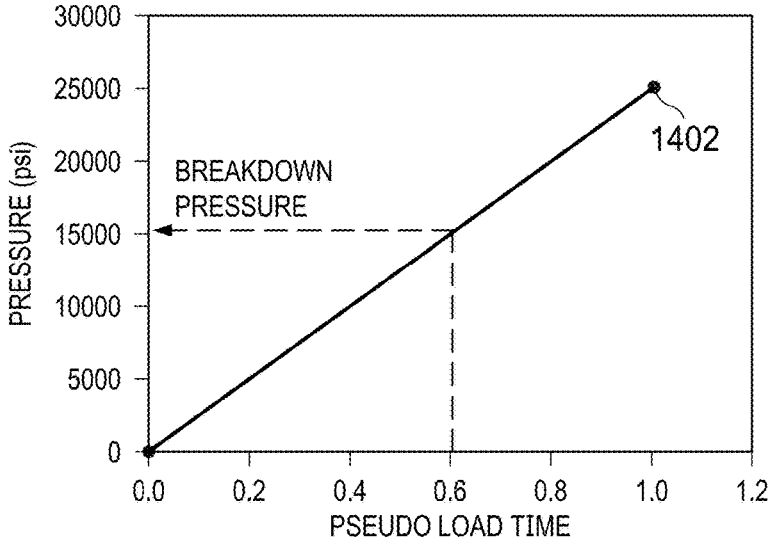
FIG. 14
FIG. 16
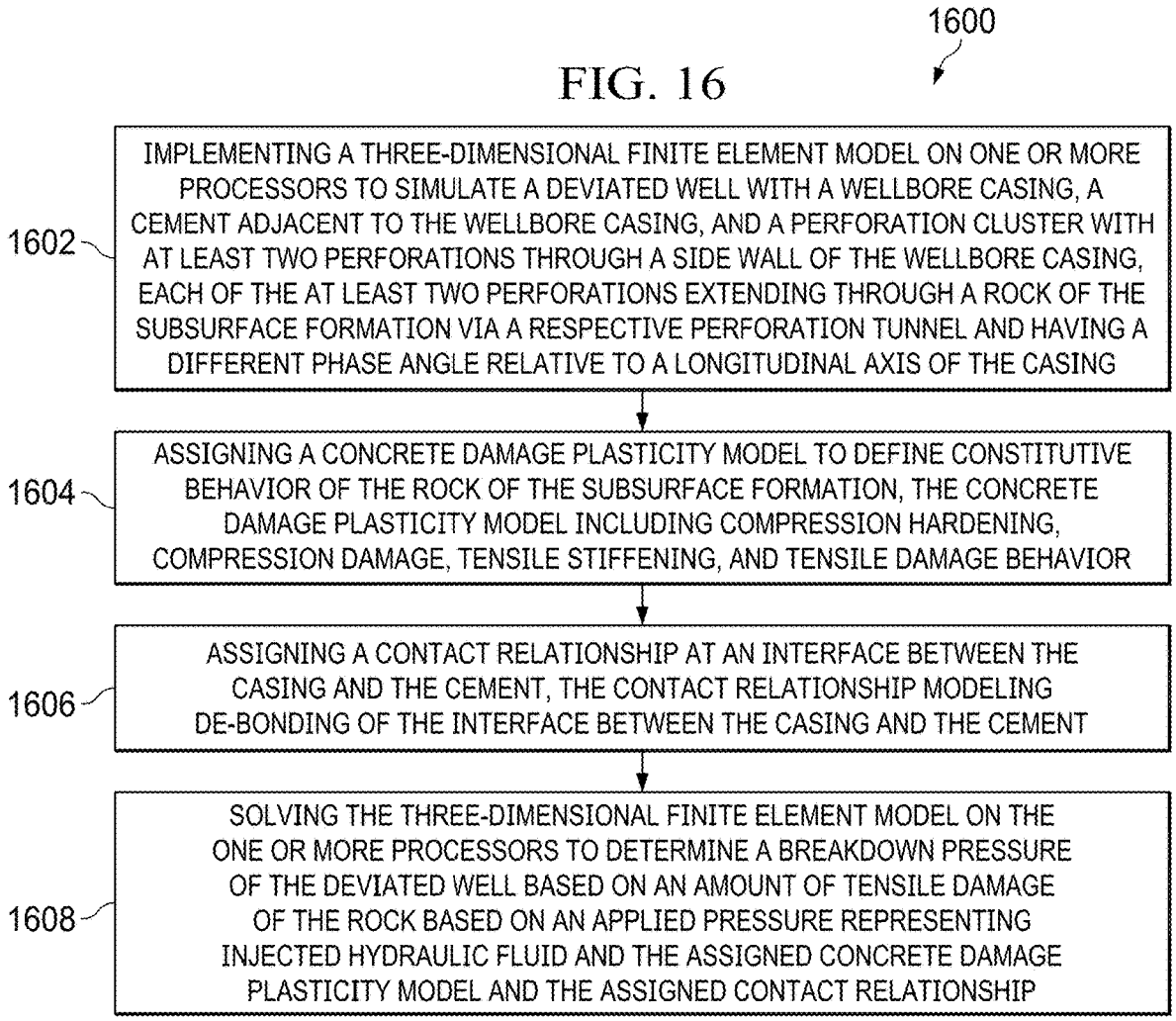

FRACTURING A SUBSURFACE FORMATION BASED ON THE REQUIRED BREAKDOWN PRESSURE

TECHNICAL FIELD

This disclosure describes systems and methods for fracturing a subsurface formation and, more particularly, fracturing a subsurface formation based on a breakdown pressure prediction from a numerical finite element model.

BACKGROUND

Hydraulic fracturing has been used to stimulate tight sandstone and shale gas reservoirs. Rock breakdown or fracture initiation is typically required for a successful hydraulic fracturing treatment. For hydraulic fracturing treatments, accurately estimating a breakdown pressure of a subsurface (or subterranean) formation may help determine correct selections of casing size, tubing size, and wellhead (for example, to correctly select their respective burst pressure limiting requirements), as well as a pump schedule design. Otherwise, the hydraulic fracturing operation may not properly inject a fracturing liquid to fracture the formation (for example, if the breakdown pressure was underestimated). Conventionally, hydraulic fracturing simulators may not accurately predict the breakdown pressure due to, for example, model simplifications.

SUMMARY

The systems and methods described in this disclosure are related to fracturing of a subsurface formation based on a breakdown pressure prediction from a numerical finite element model. A nonlinear three-dimensional (3D) finite element model includes a full 3D geometric model of a deviated, cased hole, and perforated wellbore, is able to predict fracture initiation and breakdown pressure (e.g., via simulation) of the perforated wellbore within the subsurface formation for a hydraulic fracturing treatment. For example, once an engineer has simulated the breakdown pressure for a wellbore with a particular geometry using the finite element model, the components of the hydraulic fracturing operation (e.g., pump, tubing, casing, etc.) can be properly sized to inject a fracturing liquid into well to fracture the formation.

The finite element model includes a full 3D finite element model of the casing of the wellbore, the cement of the wellbore, the perforation geometry of the wellbore, and the formation (e.g., rock) around the wellbore and around the perforations (e.g., 2D assumptions or symmetry assumptions are not necessary). The finite element model includes in-situ stresses, stress orientations, and both casing and cement geometries, mechanical (constitutive) properties, and contact properties (e.g., between the casing and the cement, and between the cement, and the formation). The finite element model includes the 3D geometry defining the perforation cluster and perforation phase angles of the perforated wellbore. Rock around the perforation tunnel is modeled using concrete damage plasticity with both compression and tensile damage such that rock damage progression as a function of wellbore pressure is simulated in the finite element model. "Breakdown pressure," in the context of the finite element model, refers to the internal casing pressure that leads to one of the perforation clusters developing the threshold amount of the tensile damage (e.g., 1%, 2%, etc.). In other words, when the threshold amount of damage is detected in at least one of the perforation clusters, the pressure applied to the internal casing pressure (e.g., representing the hydraulic fluid within the wellbore) that caused the threshold amount of damage is determined to be the breakdown pressure. The threshold amount of damage is typically pre-determined based on model calibration procedures.

Methods of hydraulic fracturing a subsurface formation can include using a three-dimensional finite element model implemented on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing; solving the three-dimensional finite element model implemented on one or more processors to determine a breakdown pressure of the deviated well based on an amount of tensile damage of the perforation cluster induced by an applied pressure representing injected hydraulic fluid; drilling and completing a deviated well with a wellbore casing size, tubing size, and wellhead selected at least in part based on the determined breakdown pressure; and injecting hydraulic fluid into the deviated well at an injection pressure determined at least in part on the determined breakdown pressure to cause hydraulic fracturing of the rock of the subsurface formation, wherein the three-dimensional finite element model includes a concrete damage plasticity model representing constitutive behavior of the rock and a contact relationship between an interface of the wellbore casing and the cement adjacent to the casing, the contact relationship modeling de-bonding of the interface of the casing and the cement.

Methods of hydraulic fracturing a subsurface formation can include implementing a three-dimensional finite element model on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing; assigning a concrete damage plasticity model to define constitutive behavior of the rock of the subsurface formation, the concrete damage plasticity model including compression hardening, compression damage, tensile stiffening, and tensile damage behavior; assigning a contact relationship at an interface between the casing and the cement, the contact relationship modeling de-bonding of the interface between the casing and the cement; and solving the three-dimensional finite element model on the one or more processors to determine a breakdown pressure of the deviated well based on an amount of tensile damage of the rock induced by an applied pressure representing injected hydraulic fluid and the assigned concrete damage plasticity model and the assigned contact relationship.

Implementations of these systems and methods can include one or more of the following features.

In some implementations, the method includes extracting material properties of the rock from log data and/or lab test data, wherein the concrete damage plasticity model includes compression hardening, compression damage, tensile stiffening, and tensile damage behavior at least in part based on the extracted material properties.

In some implementations, the method includes injecting hydraulic fluid into the deviated well by pumping the hydraulic fluid into the deviated well using a pump schedule determined at least in part based on the determined breakdown pressure.

In some implementations, the method includes selecting a wellbore casing size, a tubing size, and wellhead at least in part based on the determined breakdown pressure.

In some implementations, the method includes determining a pump schedule of a pump for injecting hydraulic fluid into the wellbore at least in part based on the determined breakdown pressure.

In some implementations, each of the at least two perforations are axially spaced relative to each other and each of the at least two perforations are angularly spaced relative to each other around a circumference of the wellbore. In some cases, the at least two perforations are six perforations located within a 20 centimeter length of the wellbore casing and angularly spaced 60 degrees apart.

In some implementations, determining the breakdown pressure includes detecting when at least one finite element representing the rock has a tensile failure above a predetermined threshold. In some cases, the predetermined threshold is a scalar between 0.0 and 0.2.

In some implementations, solving the three-dimensional finite element model comprises solving the three-dimensional finite element model using two quasi-static loading steps, a first step used for solving static equilibrium with a loading of in-situ stresses, gravity loading, overburden, and underburden, and a second step used for solving static equilibrium of an applied pressure to determine the breakdown pressure while including the loading of the first step.

In some implementations, the method includes rotating an orientation of the three-dimensional finite element model based on borehole image log data so that a well trajectory orientation and in-situ stresses are oriented in accordance with the borehole image log data.

In some implementations, an output of the solved three-dimensional finite element model is a spatially varying contour of the tensile damage of the rock.

In some implementations, a portion of the deviated well has a deviated angle of at least 10 degrees relative to a normal direction from a ground surface.

The systems and methods described in this specification provide various advantages.

The finite element model is applicable to deviated and cased holes with perforations, which is difficult to include in analytical due to model simplifications. Incorporating the effect of a deviation, the casing on the breakdown pressure prediction, and the inclusion of perforations with a particular geometry would make an analytical model intractable to solve. The finite element model accounts for these features and can be used to study model changes (e.g., such as relocating the perforations, changing the angle of the perforations, etc.) with ease.

The finite element model is not limited to vertical open-holes since the model geometry accounts for deviated and cased-holes. For example, the finite element model includes the high strength casing of the wellbore in the modeling which affects the distribution of stress throughout the wellbore and the perforation clusters which more accurately represents the physical conditions of hydraulic fracturing treatment. In scenarios where the casing is not included in the finite element model, the fluid pressure would act on the open-hole instead of the casing, which would incorrectly redistribute the stresses and change the breakdown pressure. Without a cased-hole, the finite element model would represent an open-hole fracking method which is different from a cased-hole fracking method.

The finite element model is not limited to initiating hydraulic fracture at the perforations and not limited to propagating the hydraulic fracture along a direction of maximum principal stress. For example, the finite element model is able to determine (e.g., via simulation) the location of fracture initiation which may be in a perforation cluster or in the rock around the perforation cluster. The finite element model includes perforation cluster geometry detail (e.g., a diameter of the perforation cluster is less than a diameter of a casing, etc.) and perforation geometry detail (e.g., the perforation cluster includes a first perforation with a phase angle of 60 degrees, a second perforation with a phase angle of 120 degrees, each with different lengths along the perforation cluster, etc.) so that the location of fracture initiation is determined among various perforation tunnels within a perforation cluster. In some cases, the finite element model includes a perforation cluster with six perforations and six perforations tunnels. Each perforation is angled 60 degrees relative to each other and axially spaced within a 2 ft section along the wellbore. This configuration is used in hydraulic fracturing and increases the accuracy of the breakdown prediction of the finite element model. By modeling six perforations together, the model represents a "superposition effect" where multiple perforations are simulated together to determine breakdown pressure, which further increases accuracy of the predicted breakdown pressure.

The finite element model accounts for material non-linearity (e.g., the rock, the cement, etc.) and contact non-linearity (e.g., between the casing and the cement, the cement and the formation, etc.) via a robust numerical formulation which is difficult to account for in a boundary element and/or a finite volume formulation. In some examples, boundary element and/or a finite volume formulations require linear elastic constitutive models instead of constitutive models that account for non-linearity. In this scenario, a linear elastic rock constitutive model is unable to represent the physical fracture initiation mechanism for hydraulic fracturing treatment.

The finite element model includes a constitutive model for the rock that is a concrete damage plasticity model. The concrete damage plasticity model better represents the rock tensile damage progression induced by the pressure inside the casing and the perforation surfaces of the perforations. The finite element model is not limited to determining the breakdown pressure based on maximum tensile stress, which is often an assumption in analytical models. Instead, breakdown pressure is the pressure acting on the internal casing that develops tensile damage from one perforation of the perforation cluster. Maximum tensile stress criterion is also referred as the tension cut-off, which assumes the rock will be completely damaged or lose strength once the tension stress reaches the maximum tensile stress threshold. However during the damage process, stiffness gradually decreases. Before reaching maximum tensile stress, damage might have already began, the stiffness of rock has already degraded. Maximum tensile stress method cannot account for this process. The concrete damage plasticity model better represents the rock tensile damage progression.

The finite element model includes a denser mesh representing the perforation cluster of the wellbore and the surrounding rock and a less dense mesh representing the other regions of the model. This approach lowers the overall computational cost of simulating the finite element model. One measure of mesh density is an average characteristic length of the finite elements used. In this way, as mesh density increases, so does the number of degrees of freedom of the finite element model. Increasing the number of degrees of freedom increases the accuracy of the simulation, but also increases computational cost. The finite element model accounts for this computational cost vs. accuracy tradeoff by using a denser mesh portion in regions of the finite element model where failure is likely to occur based on engineering judgement and/or via previous simulations, while using a lower mesh density (e.g., the other regions of the finite element model), where failure is not likely to occur.

The finite element model accounts for casing-cement contact instead of being fully bonded. Incorporating the contact in the finite element model better represents the physical situation of the wellbore compared to assuming that the casing-cement is fully bonded (e.g., glued or tied).

The finite element model is easier to verify by aligning the minimum horizontal stress direction with the same direction of the horizontal wellbore orientation. In a subsurface, in-situ stress is in compression state. A minimum horizontal stress direction represents the lowest compression direction. During a drilling operation, it is much easier to split the rock in the direction perpendicular to this direction than a direction along this direction. For example, drilling a horizontal well along the minimum stress direction with perforation tunnels in a direction perpendicular to the minimum horizontal stress direction is preferable. In this scenario, injecting fluid with high pressures (above the breakdown pressure) pressurize the perforation tunnel and split the rock. However, the finite element model allows for in-situ stresses to be oriented at any direction with respect to the horizontal wellbore (e.g., aligned with the wellbore, perpendicular to the wellbore, 20 degrees relative to the axis of the wellbore, etc.).

By splitting the solution process of the finite element model into two load steps, the first load step is used to account for in-situ stresses, the gravity load, top surface overburden pressure as a base state. In other words, when the second load step begins and pressure is incrementally increased, the incremental solution already incorporates the full in-situ stresses, the gravity load, top surface overburden pressure. This "two-step process" represents the physical scenario of the wellbore in the formation.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

FIG. 9A is the S11 stress result, FIG. 9B is the S22 stress result, and FIG. 9C is the S33 stress result.

FIG. 14 is a plot of the internal pressure acting on an internal casing surface vs. pseudo load time of the finite element analysis.

FIG. 16 is a flowchart of an alternate modeling method for predicting breakdown pressure for perforation hydraulic fracturing treatment.

DETAILED DESCRIPTION

The systems and methods described in this disclosure are related to fracturing of a subsurface formation based on a breakdown pressure prediction from a numerical finite element model. A nonlinear three-dimensional (3D) finite element model includes a full 3D geometric model of a deviated, cased hole, and perforated wellbore, is able to predict fracture initiation and breakdown pressure (e.g., via simulation) of the perforated wellbore within the subsurface formation for a hydraulic fracturing treatment. For example, once an engineer has simulated the breakdown pressure for a wellbore with a particular geometry using the finite element model, the components of the hydraulic fracturing operation (e.g., pump, tubing, casing, etc.) can be properly sized to inject a fracturing liquid into well to fracture the formation.

Figure 1:
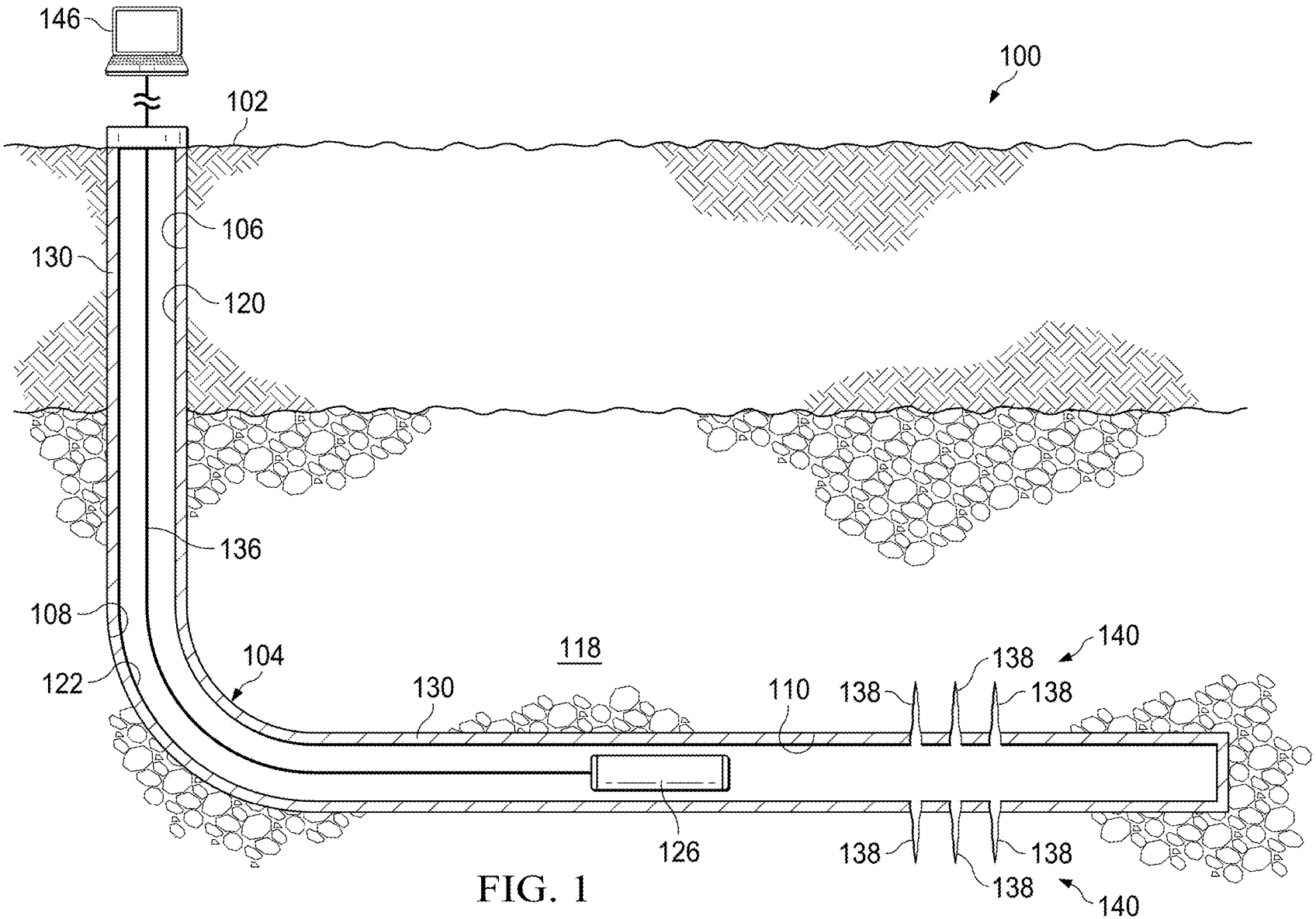
FIG. 1 is a schematic diagram of an example implementation of a wellbore system according to the present disclosure.

FIG. 1 is a schematic diagram of an example implementation of a wellbore system 100 according to the present disclosure. In some aspects, the wellbore system 100 (all or part of it) may provide a wellbore system and computational framework (for example, embodied in control system 146) for calculating a breakdown pressure of a subterranean formation. In some aspects, the wellbore system 100 (and the computational framework) provides such a determination for a deviated, cased-hole, and clustered perforation hydraulic fracturing treatment, while taking into account an impact of casing-cement mechanical properties on the breakdown pressure.

In some aspects, the computational framework (for example, executed on a control system 146) of wellbore system accounts for one or more effects of casing-cement intermediate layers in a deviated wellbore to calculate the breakdown pressure of a subterranean formation. The computational framework of wellbore system 100 may also account for a potential effect of perforation quality on estimating the breakdown pressure of a subterranean formation. The computational framework of wellbore system 100 improves current available models on calculating breakdown pressure, for example, which are applicable to deviated, cased wellbores, and clustered perforation hydraulic fracturing treatments.

As illustrated, the wellbore system 100 includes a wellbore 104 formed (for example, drilled or otherwise) from a terranean surface 102 and to and into subterranean formation 118. Although the terranean surface 102 is illustrated as a land surface, terranean surface 102 may be a sub-sea or other underwater surface, such as a lake or an ocean floor or other surface under a body of water. Thus, the present disclosure contemplates that the wellbore 104 may be formed under a body of water from a drilling location on or proximate the body of water.

The illustrated wellbore 104 is a directional wellbore in this example of wellbore system 100. For instance, the wellbore 104 includes a substantially vertical portion 106 coupled to a radiussed or curved portion 108, which in turn is coupled to a substantially horizontal portion 110. As used in the present disclosure, "substantially" in the context of a wellbore orientation, refers to wellbores that may not be exactly vertical (for example, exactly perpendicular to the terranean surface 102) or exactly horizontal (for example, exactly parallel to the terranean surface 102). In other words, those of ordinary skill in the drill arts would recognize that vertical wellbores often undulate offset from a true vertical direction that they might be drilled at an angle that deviates from true vertical, and horizontal wellbores often undulate offset from a true horizontal direction. Further, the substantially horizontal portion 110, in some aspects, may be a slant wellbore or other directional wellbore that is oriented between exactly vertical and exactly horizontal. The substantially horizontal portion 110, in some aspects, may be oriented to follow a slant of the formation. As illustrated in this example, the three portions of the wellbore 104—the vertical portion 106, the radiussed portion 108, and the horizontal portion 110—form a continuous wellbore 104 that extends into the Earth. Thus, in this example implementation, at least a portion of the wellbore 104, such as the radiussed portion 108 and the horizontal portion 110, may be considered a deviated wellbore, in other words, a non-vertical wellbore.

The illustrated wellbore 104 has a surface casing 120 positioned and set around the wellbore 104 from the terranean surface 102 into a particular depth in the Earth. For example, the surface casing 120 may be a relatively large-diameter tubular member (or string of members) set (for example, cemented) around the wellbore 104 in a shallow formation. As used herein, "tubular" may refer to a member that has a circular cross-section, elliptical cross-section, or other shaped cross-section. As illustrated, a production casing 122 is positioned and set within the wellbore 104 downhole of the surface casing 120. Although termed a "production" casing, in this example, the casing 122 may or may not have been subject to hydrocarbon production operations. Thus, the casing 122 refers to and includes any form of tubular member that is set (for example, cemented) in the wellbore 104 downhole of the surface casing 120. In some examples of the wellbore system 100, the production casing 122 may begin at an end of the radiussed portion 108 and extend throughout the substantially horizontal portion 110. The casing 122 could also extend into the radiussed portion 108 and into the vertical portion 106.

As shown, cement 130 is positioned (for example, pumped) around the casings 120 and 122 in an annulus between the casings 120 and 122 and the wellbore 104. The cement 130, for example, may secure the casings 120 and 122 (and any other casings or liners of the wellbore 104) through the subterranean layers under the terranean surface 102. In some aspects, the cement 130 may be installed along the entire length of the casings (for example, casings 120 and 122 and any other casings), or the cement 130 could be used along certain portions of the casings if adequate for the particular wellbore 104. Other casings, such as conductor casings or intermediate casings, are also contemplated by the present disclosure for the wellbore system 100.

As illustrated, the wellbore 104 extends through one or more subterranean layers (not specifically labeled) and lands in subterranean formation 118. The subterranean formation 118, in this example, may be chosen as the landing for the substantially horizontal portion 110, for example, in order to initiate completion operations such as hydraulic fracturing operations and ultimately recover hydrocarbon fluids from the subterranean formation. In some examples, the subterranean formation 118 is composed of shale or tight sandstone. Shale, in some examples, may be source rocks that provide for hydrocarbon recovery from the subterranean formation 118.

As shown in FIG. 1, the wellbore system 100 includes one or more perforation tunnels 138 (also known as perforations 138) that are formed from the wellbore 104, through the casing 122 and the cement 130, and extend into the subterranean formation 118. Generally, the perforation tunnels 138 may be formed by, for example, shaped explosive charges, water jetting, laser, or other conventional perforating techniques. In some aspects, multiple perforation tunnels 138 may comprise a perforation stage 140. Each perforation tunnel 138, as well as each perforation cluster 140, may provide a path (or paths) for a hydraulic fracturing liquid (with or without proppant) to enter the subterranean formation 118 from the wellbore 104 in order to initiate and propagate hydraulic fractures (extending from the perforation tunnels 138) through the subterranean formation 118.

As shown in FIG. 1, the example implementation of the wellbore system 100 also includes a logging tool 126 that is communicably coupled to a downhole conveyance 136, such as a wirelines, optical line, or other data communication cable. The downhole conveyance 136 provides data from the logging tool 126 to the control system 146, for real time (for example, during logging operations) or later usage in determining a breakdown pressure of the subterranean formation 118. In some aspects, the control system 148 comprises a microprocessor based control system that includes, for example, one or more hardware processors, one or more memory storage devices (for example, tangible, non-transitory computer-readable memory modules), one or more network interfaces, and one or more input/output devices, including, for example, a graphical user interface (GUI) to present one or more determinations or data from the computer framework for determining a breakdown pressure of a subterranean formation.

In-situ Stresses and Classical Solutions of Breakdown Pressure for Vertical Open-Hole Wells In-situ stresses act on a wellbore formed through a subsurface formation. For example, in some aspects, the logging tool 126 may derive or generate an image log of the subterranean formation 118, from which the maximum horizontal principal stress angle of the subterranean formation 118 can be obtained. From the maximum horizontal principal stress angle and borehole image (breakout and breakdown), a maximum horizontal principal stress of the subterranean formation 118 can be estimated and calibrated together with the vertical stress and minimum horizontal principal stress and finally determined.

In some aspects, the in-situ stresses can be calculated according to a number of parameters. For example, such parameters may include the image log, which includes wellbore TVD, azimuth, and deviation. The parameters may also include density log, stress orientations. The parameters may also include the mechanical properties of, for example, the casing 122, the cement 130, and the subterranean formation 118 itself.

For example, an in-situ stress field of the subterranean formation 118 exists in the far field and takes the form as follows:

$$\sigma_{in} = \begin{pmatrix} \sigma_{xx} & \tau_{xy} & \tau_{xz} \\ \tau_{yx} & \sigma_{yy} & \tau_{yz} \\ \tau_{zx} & \tau_{zy} & \sigma_{zz} \end{pmatrix} \text{ or } \tag{1}$$

$$\sigma_{Pr} = \begin{pmatrix} \sigma_{Hmax} & 0 & 0 \\ 0 & \sigma_{Hmin} & 0 \\ 0 & 0 & \sigma_V \end{pmatrix}.$$

In Eq. 1, $\sigma_{Hmax}$ and $\sigma_{Hmnin}$ are the maximum and minimum horizontal stresses respectively, and $\sigma_V$ is the principal vertical stress component. The dynamic Young's modulus and Poisson's ratio can be calculated using, for example, a sonic log from the logging tool 126, then converted to a static modulus based on correlations. The vertical stress $S_V$ (total stress) or $\sigma_V$ (effective stress) can be reasonably calculated based on, for example, a density log of the logging tool 126, as:

$$S_V = \int \rho dZ, \sigma_V = S_V - \alpha P_0 \tag{2}$$

Without considering tectonic stresses, the effective and total minimum horizontal stress can be approximately calculated by:

$$\sigma_{Hmin} = \frac{\mu}{1-\mu}\sigma_V, S_{Hmin} = \frac{\mu}{1-\mu}(\sigma_V - \alpha P_0) + \alpha P_0. \tag{3}$$

In Eq. 3, $\alpha$ is the Biot's poroelastic parameter and $P_0$ is reservoir pressure. The maximum principal stress can be estimated based on, for example, the image log by calibrating the maximum horizontal stress magnitude against a drilling fluid ("mud") weight and observed breakout and breakdown zone exhibited in the image log data.

In a conventional analysis for a vertical open-hole, the maximum horizontal principal stress can be obtained based on the breakdown pressure from a leak off test during drilling. The above equation assumes the horizontal strain equal to zero. Under the tectonic regime with given horizontal strains $\varepsilon_{Hmax}$ and $\varepsilon_{Hmin}$, the maximum and minimum horizontal stresses can be generally calculated by:

$$S_{Hmin} = \frac{\mu}{1-\mu}(\sigma_V - \alpha P_0) + \alpha P_0 + \frac{E}{1-\mu^2}(\varepsilon_{Hmin} + \mu\varepsilon_{Hmax}), \tag{4}$$

$$S_{Hmax} = \frac{\mu}{1-\mu}(\sigma_V - \alpha P_0) + \alpha P_0 + \frac{E}{1-\mu^2}(\mu\varepsilon_{Hmin} + \varepsilon_{Hmax}). \tag{5}$$

Drilling the wellbore 104 in and through the subterranean formation 118 leads to a stress redistribution around the wellbore 104. The wellbore 104 is generally supported by drilling fluid pressure acting on the wellbore wall. Accurately estimating the stresses around the wellbore 104 may be necessary for wellbore stability. Also, it may be helpful to determine the breakdown pressure for hydraulic fracturing design, which directly impacts the selection of casing size, treatment tubing size, wellhead, steel grade, pump schedule, and other equipment.

Figure 2:
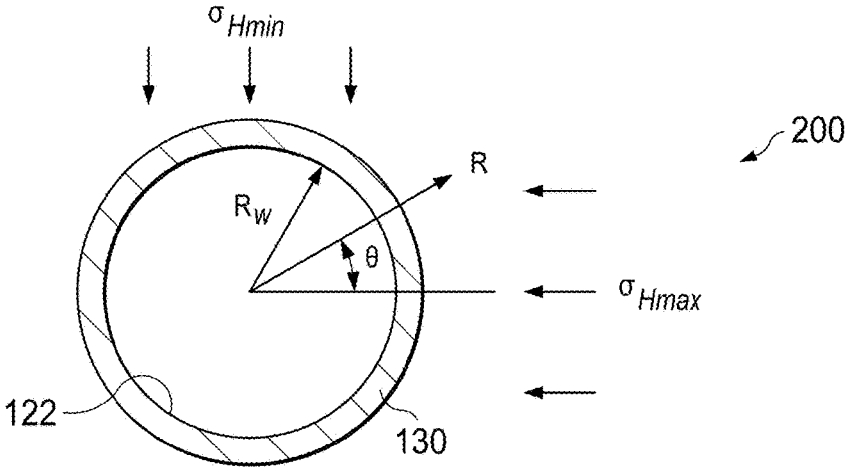
FIG. 2 is a schematic cross-section of a cased, vertical wellbore with particular stresses according to the present disclosure.

For example, FIG. 2 illustrates a schematic top view cross-section 200 of a cased, vertical wellbore with particular stresses. In cross-section 200, $R_w$ represents the wellbore radius, and R represents a radial distance from the concentric center of the casing 122 and cement 130, along with the effective total minimum and maximum horizontal stresses, $\sigma_{Hmax}$ and $\sigma_{Hmin}$.

For a conventional, vertical open-hole wellbore, it is a generally accepted convention that the three far field principal stresses and orientation are known for a conventional vertical, open-hole wellbore. The elastic solutions of the effective stresses around wellbore based on plane strain condition are given by:

$$\sigma_r = \frac{(\sigma_{Hmax} + \sigma_{Hmin})}{2}\left(1 - \frac{R_w^2}{R^2}\right) + \frac{(\sigma_{Hmax} - \sigma_{Hmin})}{2}\left(1 - 4\frac{R_w^2}{R^2} + 3\frac{R_w^4}{R^4}\right) + (P_w - P_0)\frac{R_w^2}{R^2}, \tag{6}$$

$$\sigma_\theta = \frac{(\sigma_{Hmax} + \sigma_{Hmin})}{2}\left(1 + \frac{R_w^2}{R^2}\right) + \frac{(\sigma_{Hmax} - \sigma_{Hmin})}{2}\left(1 + 3\frac{R_w^4}{R^4}\right)\cos 2\theta - (P_w - P_0)\frac{R_w^2}{R^2}. \tag{7}$$

The above equations are also called by Kirsch Equation. In Eqs. 6 and 7, $\sigma_r$ is the radial stress acting outwards from the wellbore; $\sigma_\theta$ is the hoop stress around the wellbore; $\theta$ is the angle from the direction of $\sigma_{xx}$; $P_w$ is the wellbore pressure; and $P_0$ is the reservoir pressure. For an open-hole wellbore, limiting this to the wellbore wall with $R=R_w$ leads to:

$$\sigma_r = P_w - P_0, \tag{8}$$

$$\sigma_\theta = (\sigma_{Hmax} + \sigma_{Hmin}) - 2(\sigma_{Hmax} - \sigma_{Hmin})\cos 2\theta - (P_w - P_0), \tag{9}$$

$$\tau_{r\theta} = 0. \tag{10}$$

For the hydraulic fracturing, tensile failure criteria is generally used to direct the fracture propagation trajectory;

therefore a fracture propagates at the direction of maximum horizontal stress. The corresponding hoop stress at θ=0 yields:

$$\sigma_\theta=3\sigma_{Hmin}-(P_w-P_0) \quad (11).$$

Breakdown pressure is determined based on tensile failure. If the hoop stress turns into tension at wellbore wall and exceeds the material's tensile strength T, the material (in other words, the rock) will fail in tensile mode:

$$\sigma_\theta=-T \quad (12),$$

$$P_w=3\sigma_{Hmin}-\sigma_{Hmax}+P_0+T \text{ (in terms of effective stress)} \quad (13).$$

Eq. 13 is generally used to predict the required drilling mud weight in the conventional, vertical open-hole example, which can avoid wellbore breakdown issues during drillings. For horizontal wells drilled in the subterranean formations (such as deep and tight reservoirs), the horizontal parts are generally drilled in the minimum horizontal stress direction and thereafter is cased and cemented. After perforating the casing, fluid injection is executed to initiate hydraulic fractures from the perforation towards the maximum horizontal stress direction. In such situations, the computational framework of the present disclosure may calculate the hoop stress around the perforation tunnel for judging whether fracture can be initiated or not, even though the hoop stress with respect to the wellbore is not the main concern. For a cased and cemented wellbore with perforation clusters (such as wellbore 104). The breakdown pressure refers to the bottomhole pressure inside the casing that leads to tensile failure within the area of the wellbore-perforation interface. Therefore, Eq. 13 cannot be directly used to estimate the breakdown pressure for deviated, cased wellbores with clustered perforations for a hydraulic fracturing treatment (such as wellbore 104).

3D Nonlinear Finite Element Model for Simulating Breakdown Pressure

Figure 3:
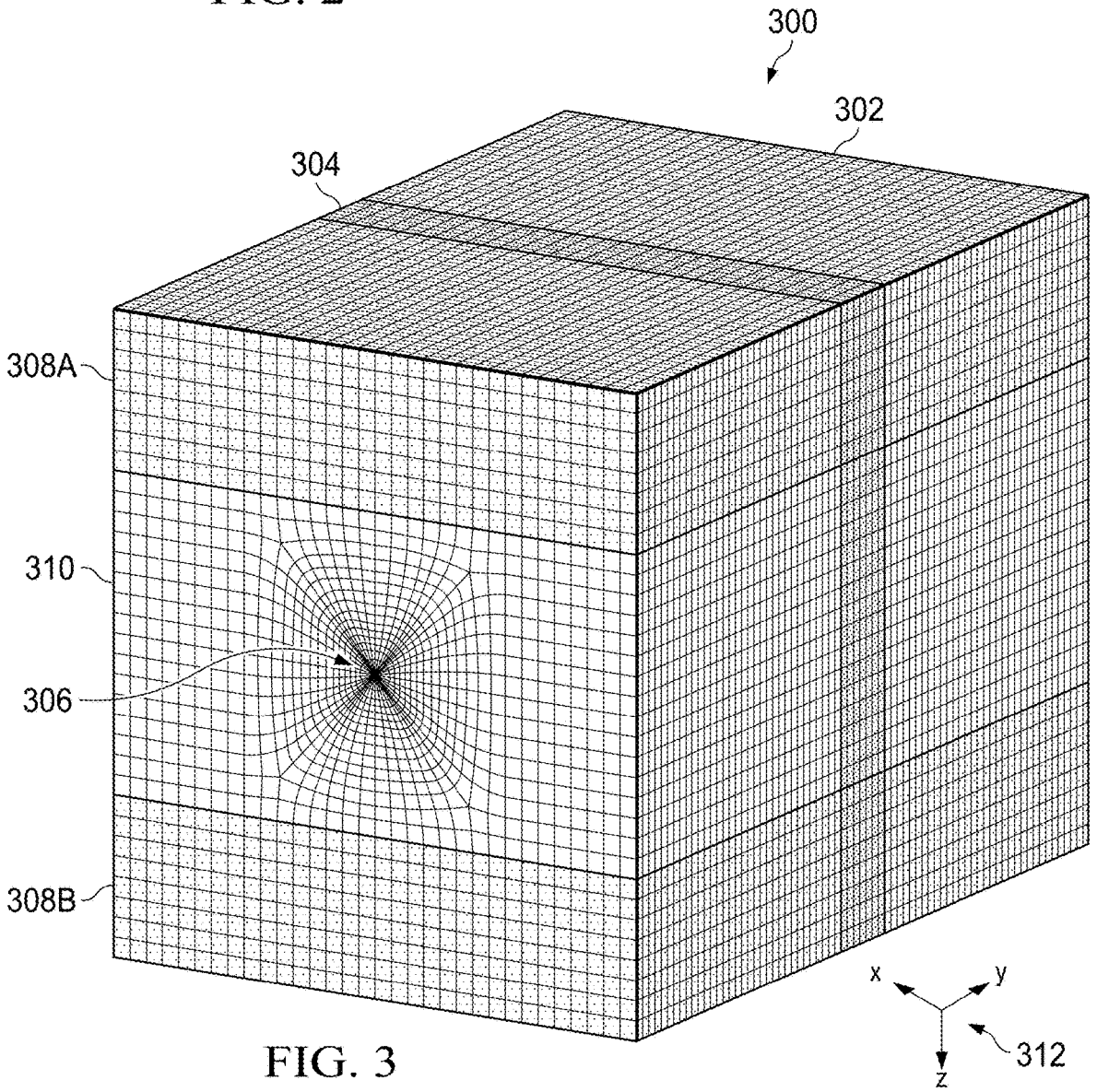
FIG. 3 is a perspective view of a 3D finite element model for predicting breakdown pressure.

FIG. 3 is a perspective view of a 3D finite element model 300 for simulating (or predicting) breakdown pressure. The finite element model 300 includes the geometric configuration of a perforated wellbore 306 that includes a casing with cement around the casing and includes a formation 310 around the casing. In some cases, perforated wellbore 306 is the same as, or similar to, the wellbore 104 described with reference to FIG. 1.

FIG. 3 shows an example 3D domain 302 of the finite element model 300 (and the mesh used to discretize the domain). The mesh includes mostly hexahedral finite elements. The domain 302 extends 12 meters in the x-direction of the coordinate system 312, 8 meters in the y-direction of the coordinate system 312 (e.g., axial direction), and 8 meters in the z-direction of the coordinate system 312 (e.g., vertical direction). In other examples, the domain 302 extends less than or more than 12 meters in the x-direction (e.g., 8 meters, 16 meters, etc.), less than or more than 8 meters in the y-direction (e.g., 8 meters, 16 meters, etc.), and less than or more than 8 meters in the vertical direction (e.g., 4 meters, 12 meters, etc.). In some cases, symmetry and/or periodic boundary conditions are applied to reduce the computational effort.

FIG. 3 represents a finite element model 300 with the perforated wellbore 306 aligned in a horizontal direction (e.g., the y-direction). This scenario represents the wellbore 104 (shown in FIG. 1) that includes the substantially vertical portion 106 coupled to the substantially horizontal portion 110 where the perforation cluster 140 is located. In other examples, the perforated wellbore 306 is modelled at an angle relative to the vertical portion 106 (e.g., 15 degrees, 30 degrees, 45 degrees, 60 degrees, 75 degrees, etc.) and the model is not limited to the horizontal direction as shown in FIG. 3.

The finite element model 300 includes overburden 308A and underburden 308B which are assigned different properties to account for additional stresses exerted on the wellbore 306. Properties for the overburden 308A include Young's modulus, Poisson's ratio, and density, and properties for the underburden 308B include Young's modulus, Poisson's ratio, density. In most cases, overburden and underburden are modeled using linear elasticity and assigned with in-situ stresses. The finite element model 300 includes a denser mesh partition 304 representing the axial position of the perforation cluster of the wellbore 306 and the rock formation radially surrounding the perforation cluster.

Figure 4:
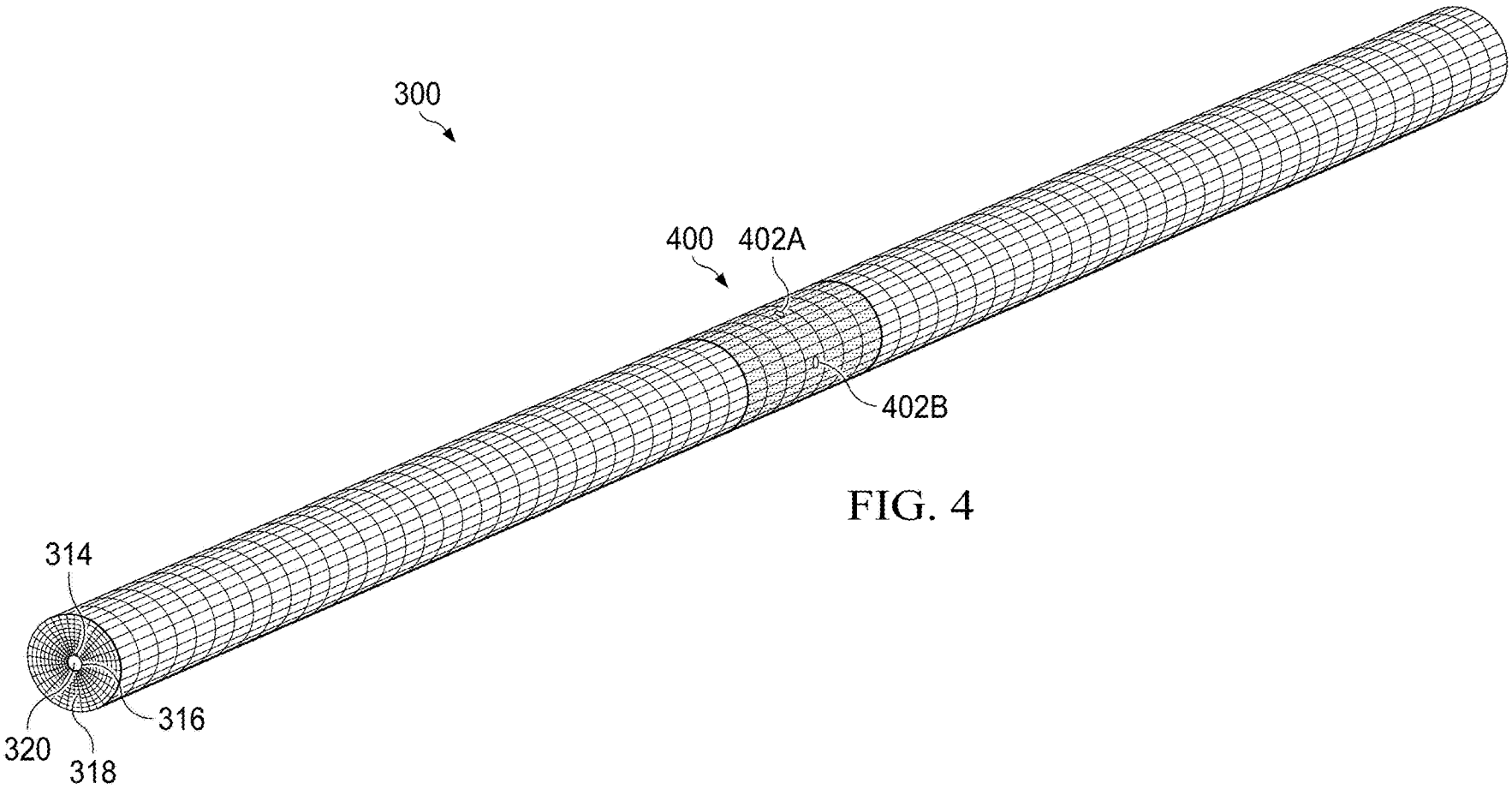
FIG. 4 is a perspective view of the 3D finite element model of FIG. 3 showing the near wellbore section with the perforation cluster.

FIG. 4 is a perspective view of the finite element model 300 showing the wellbore 306 and the perforation cluster 400 of the wellbore 306 in detail. FIG. 4 shows the cased borehole 320, the casing 314 around the borehole 320, the cement 316 around the casing 314, and a part of the formation 318 around the cement 316 (e.g., the remainder of the formation 318 is shown in FIG. 3—see also FIG. 5 for additional geometric detail). The central bore of the wellbore 306 is not explicitly modeled because a pressure load is applied to the inner diameter of the casing in lieu of modeling the fluid explicitly.

In some cases, the perforation cluster 400 is the same as, or similar to, the perforation cluster 140 described with reference to FIG. 1. While the finite element model 300 incudes one perforation cluster 400, in some cases, the finite element model 300 (and/or wellbore 104) includes more than one perforation cluster (e.g., two, three, four perforation clusters, etc.). The perforation cluster 400 includes perforations 402A, 402B (generally perforations 402) that are modeled with a circular cross section. The perforations include various perforation angles around the circumference of the wellbore 306 (e.g., 15 degrees from the x-direction, 60 degrees from the x-direction, etc.) and various axial positions along the wellbore 306 (e.g., 10 centimeters apart from each other, etc.). In this example, the perforation cluster 400 includes six perforations with phase angle of 60 degrees (e.g., they are oriented with an angular spacing of 60 degrees apart from each other). Details of the angular spacing of the perforations is described with reference to FIG. 7.

Figure 5:
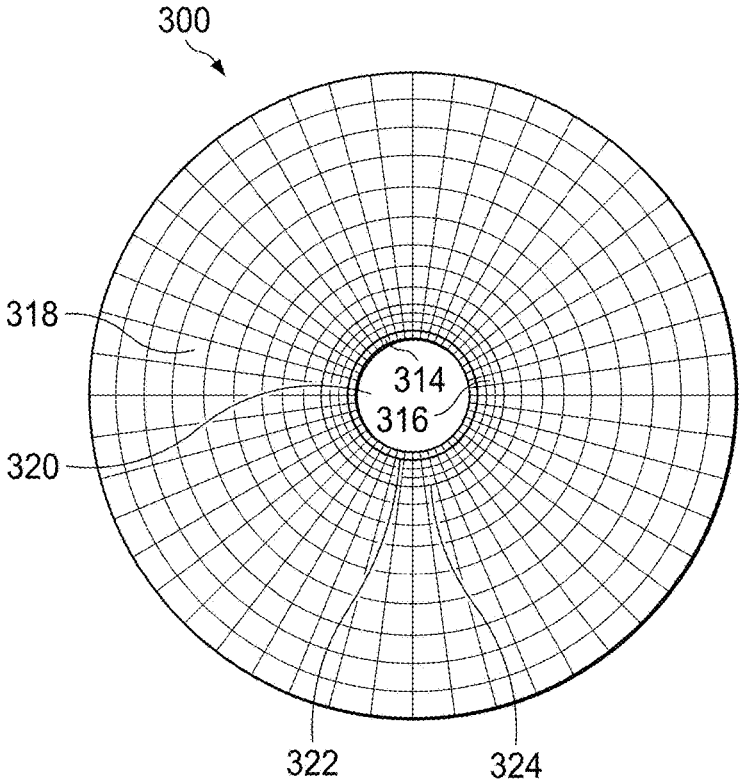
FIG. 5 is a cross section view of a cased borehole.

FIG. 5 is a cross section view of the perforated wellbore 104 that includes the cased borehole 320, the casing 314, the cement 316, and part of the formation 318 as described with reference to FIG. 4. In this example, the borehole 320 diameter is 150 millimeters (5⅞ inches) and the casing internal diameter is 114.3 millimeters (4½ inches). In other cases, the borehole 320 diameter is less than or greater than 150 millimeters (e.g., 100 millimeters, 200 millimeters, etc.) and the casing internal diameter is less than or greater than 114.3 millimeters (e.g., 100 millimeters, 200 millimeters, etc.). The casing-cement interface 322 is modeled using contact mechanics behavior. The cement-formation interface 324 is also modeled using contact mechanics behavior. In some cases, the contact mechanics behavior includes a tangential frictional coefficient of 0.4. In other cases, a tangential frictional coefficient greater than or less than 0.4 is used (e.g., 0.2, 0.3, 0.5, 0.6, etc.).

Figure 6:
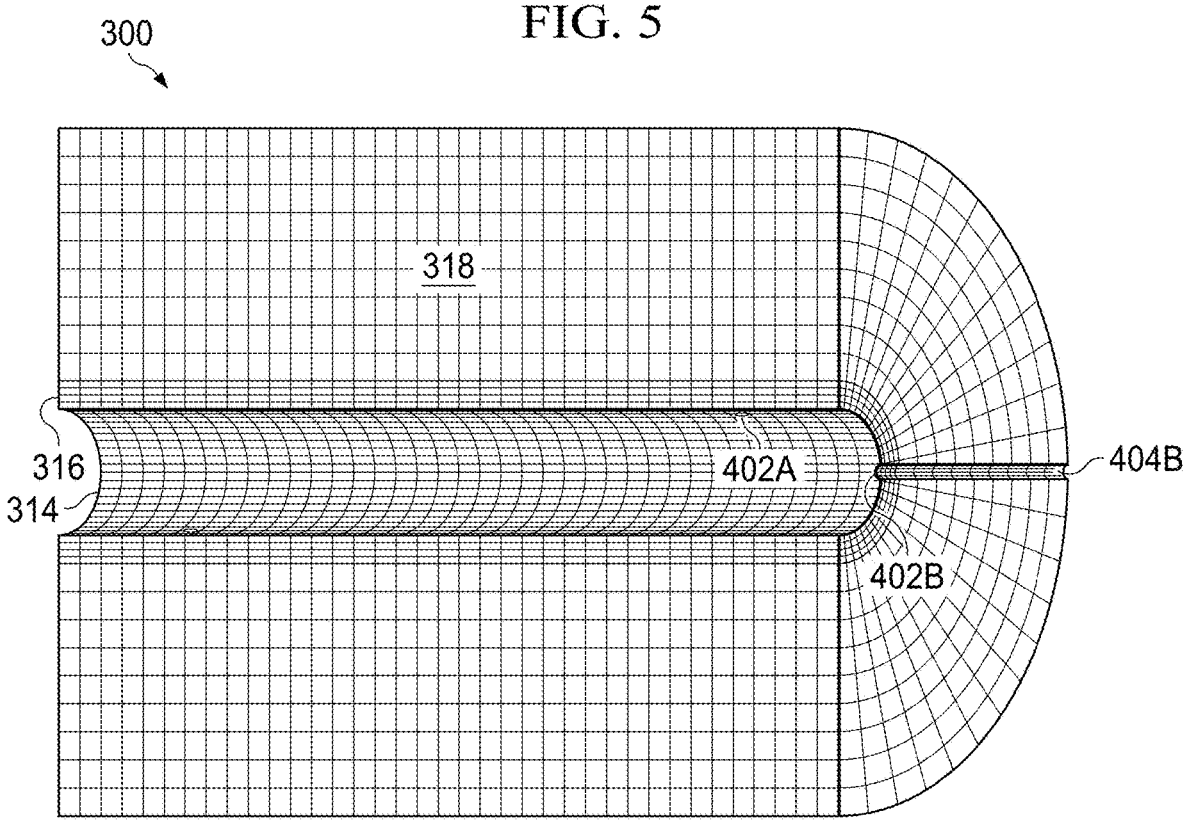
FIG. 6 is a perspective view of the 3D finite element model of FIG. 3 showing casing-cement interaction and a perforation tunnel.

FIG. 6 is a perspective view of the finite element model 300 showing a perforation tunnel 404B of the perforation 402B. The perforation tunnel for perforation 402A is obscured by the finite element model 300 in this view. A section cut through perforation tunnel 404B shows the detailed mesh strategy used to represent the perforated wellbore 306 which includes the casing 314, the cement 316, the formation 318, and the perforation cluster 400. The perforation cluster 400 includes multiple perforations 402A, 402B, and respective perforation tunnels 404B. In this example, the perforation cluster 400 includes six perforations 402 and each perforation 402 includes a perforation tunnel 404. Each perforation tunnel 404 radially extends into the formation 318. In other models, less than or greater than six perforations (e.g., 1, 2, 4, 10 perforations, etc.) are included in the finite element model.

Figure 7:
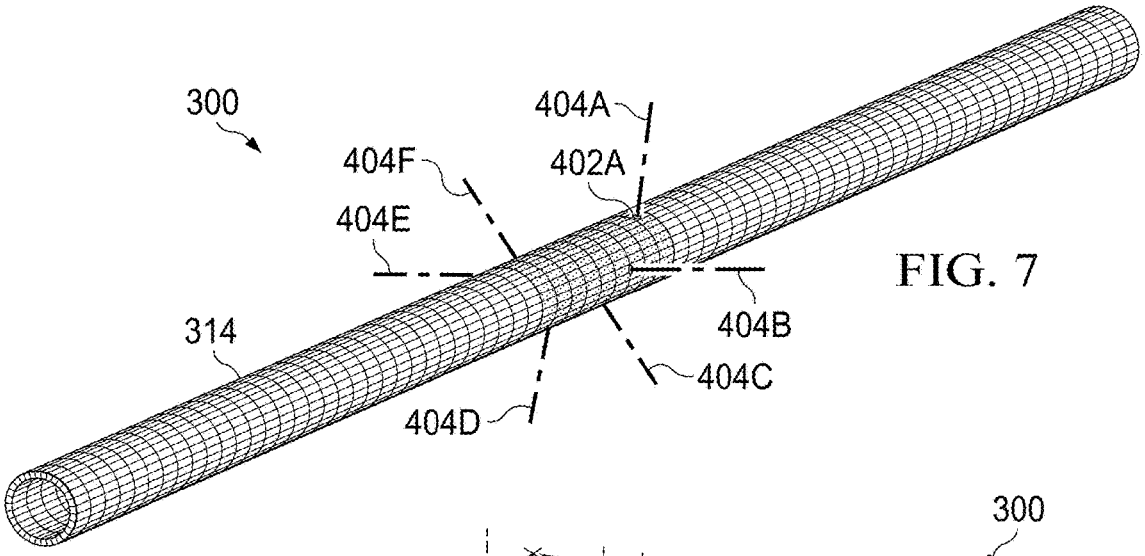
FIG. 7 is a perspective view of the 3D finite element model of FIG. 3 showing the perforated borehole with phase angle of 60 degrees.

FIG. 7 is a perspective view of the finite element model 300 showing the casing 314 and the projected location for each of the six perforations 402 and perforation tunnels 404A-F. The perforations 402 have a phase angle of 60 degrees relative to each other and are axially spaced apart within a 2 ft section along the wellbore 306. In this example, the perforation cluster 400 is 150 millimeters (5.9 inches) in the length and 10.67 millimeters (0.42 inches) in diameter. In this example, the perforation diameter 400 has a diameter of 0.42 inches which is more than 10× smaller than a diameter of the borehole 320 (which is 5.875 inches).

The casing 314, the cement 316, and the formation are assigned material properties for a constitutive model. In some cases, the material properties used in the finite element model 300 are extracted or calculated from log data and/or lab test data, such as Young's modulus, Poisson's ratio, frictional angle, tensile strength, unconfined compressive strength, cohesion, etc. In some examples, the logging tool 126 as described with reference to FIG. 1 is used to determine the material properties.

In this example, the casing 314 is assumed to deform elastically so a linear elastic material model is used to represent the constitutive behavior of the casing. In most scenarios, failure of the casing 314 is unlikely since the stresses that develop within the casing 314 at the breakdown pressure are often within the elastic range.

The cement 316 and rock (or formation) 318 surrounding the perforation are defined with different concrete damage plasticity models. In this example, the cement 316 is considered plastic, but has different properties from rock 318. Generally, is difficult to determine cement 316 properties accurately because of downhole variations in the properties of the cement 316 and difficultly obtaining the samples for testing to determine the material properties. In this scenario, the properties of the concrete damage plasticity models for the cement 316 are extracted from (or based on) lab testing and/or lab data. In most cases, nominal cement 316 properties are used that include an elastic modulus of 8,666 MPa and Poisson's ratio of 0.23.

The material model for the rock 318 is oftentimes more important than the cement 316 because the rock 318 is where fracture is likely to occur. The material model for the rock 318 includes different yield strengths in tension and compression, softening behavior in tension as opposed to initial hardening followed by softening in compression, different degradation of the elastic stiffness in tension and compression, and stiffness recovery effects during loading and unloading. In this example, the rock's material model includes an elastic modulus of 52,941 MPa, a Poisson's ratio of 0.24, and the frictional angle of rock is assumed to be 35 degrees. In some examples, the properties of the concrete damage plasticity models for the rock 318 are extracted from (or based on) lab testing and/or lab data.

Tables 1 and 2 represent the damage parameters used in the material model for the rock in the finite element model 300.

TABLE 1

Material model parameters for compression damage.

| Compression hardening | | Compression damage | |
|---|---|---|---|
| Inelastic strain | Stress (mPa) | Damage scalar | Plastic strain |
| 0.00000 | 180 | 0.000 | 0.00000 |
| 0.00046 | 230 | 0.000 | 0.00046 |
| 0.00120 | 245 | 0.000 | 0.00120 |
| 0.00300 | 200 | 0.184 | 0.00215 |
| 0.00500 | 100 | 0.592 | 0.00226 |
| 0.00700 | 50 | 0.796 | 0.00332 |
| 0.01000 | 20 | 0.918 | 0.00575 |

TABLE 2

Material model parameters for tensile damage.

| Tensile stiffening | | Tension damage | |
|---|---|---|---|
| Inelastic strain | Stress (mPa) | Damage scalar | Plastic strain |
| 0.00000 | 0.0 | 0.000 | 0.00000 |
| 0.00010 | 10 | 0.000 | 0.00010 |
| 0.00022 | 5.0 | 0.500 | 0.00013 |
| 0.00033 | 2.0 | 0.800 | 0.00018 |
| 0.00045 | 0.5 | 0.950 | 0.00027 |
| 0.00060 | 0.1 | 0.990 | 0.00041 |

Fracture initiation is tensile failure whenever the induced tensile stresses around perforations tunnels 404 exceeds the rock tensile strength. The damage parameter and corresponding plastic strain are calculated as a part of the model solution process (e.g., to satisfy equilibrium). Damage scalar ranges from zero to one such that no rock damage is present if the damage scalar equals to zero and the rock is completely damaged (e.g., broken-down) if the damage scalar equals one. The finite element model 300 is solved to determine breakdown pressure based on the locations around the perforations 402 and perforation tunnels 404 that develop tensile damage indicating that the rock is broken-down.

Figure 8:
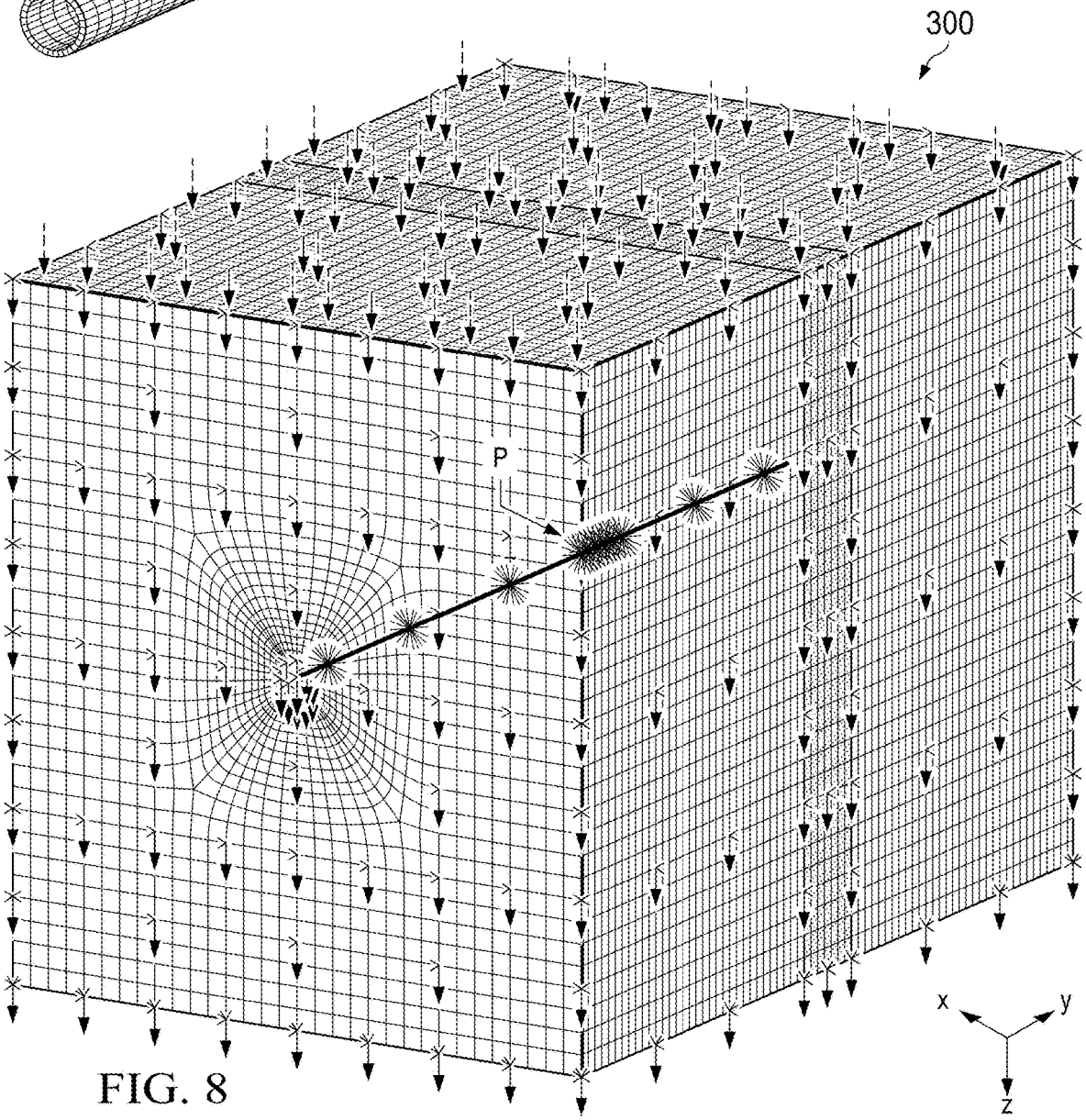
FIG. 8 is a perspective view of the 3D finite element model of FIG. 3 showing the loads considered in the finite element model.

FIG. 8 is a perspective view of the finite element model 300 showing the loads considered in the finite element model 300. The different types of loads include in-situ stresses, overburden stress, gravity, and internal pressure acting on the casing and perforation cluster. In this example, the in-situ stress is defined by two depth points: a top surface (e.g., negative z-direction as shown in FIG. 3) vertical stress of 53.4266 MPa and a bottom point (e.g., a positive z-direction) of vertical stress 53.5532 Pa. The top-to-bottom distance is 8 meters corresponding to the size of the domain 302 in the z-direction. Gravity is typically defined as a volumetric load acting in the positive z-direction with a magnitude of 9.81 $m/s^2$. The pressure acting on the casing and the perforation cluster is defined using targeted maximum bottom-hole pressure.

In this example, the wellbore 306 is assumed to be drilled in a normal stress regime and the horizontal part is at the minimum horizontal stress direction for the purpose of good hydraulic fracturing stimulation. The maximum horizontal stress direction is aligned with the x-direction and the minimum horizontal stress direction is aligned with the y-direction. In this case, the two horizontal in-situ stresses are defined as $0.45\sigma_V$ and $0.22\sigma_V$, in the x-direction and y-direction, respectively. The three principal stresses are related by $\sigma_V > \sigma_{Hmax} > \sigma_{Hmin}$ which initiates transverse fractures in the rock and propagates the fractures along the maximum horizontal stress direction.

The finite element model 300 includes two load steps to predict the breakdown pressure. The first load step defines the in-situ stresses, gravity load, top surface overburden pressure. The second load step defines the applied pressure on the internal casing surface and all the perforation surfaces.

FIG. 14 is a plot of the solution progression of the finite element solver when solving the finite element model 300. FIG. 14 shows the applied pressure $P_w$ acting on internal casing surface vs. pseudo load time of the second load step. "Pseudo load time" represents a fraction of the total load step (e.g., from zero to one) and does not represent physical time units. In this example, the applied pressure $P_w$ is uniform and assumed to simultaneously act on the internal radial surface of the casing 314 and the internal radial surfaces of each perforation tunnel 404. In other examples, the pressure acting on each of the perforation tunnels 404 is different from the pressure acting on the internal radial surface of the casing 314.

During the solution process, the finite element solver incrementally increases the applied pressure to a predetermined pressure limit 1402 while solving for pressures of all the elements within the finite element model 300 at each step. For example, in some cases, the solver uses 100 increments to reach the targeted maximum bottom-hole pressure 1402. At each increment, tensile damage for each of the elements within the rock is determined by solving for equilibrium (e.g., quasi-static equilibrium). Once one or more elements in the finite element model 300 reach a tensile damage threshold, the breakdown pressure is determined to the pressure of the particular increment. As shown in the example of FIG. 14, if tensile damage is detected at a pseudo load time of 0.60 (e.g., via an engineer interpreting the results or a post-processing script executing on the computer), the breakdown pressure would be about 15000 psi. The relationship between the applied pressure and incremental solution time is linear and the pressure gradually ramps up from zero to the targeted maximum bottom-hole pressure 1402. In some cases, locations of rock 318 within the finite element model 300 with high tensile stress results represent regions of the rock 318 where fractures are likely to occur.

Finite Element Model Results

Figure 9A:
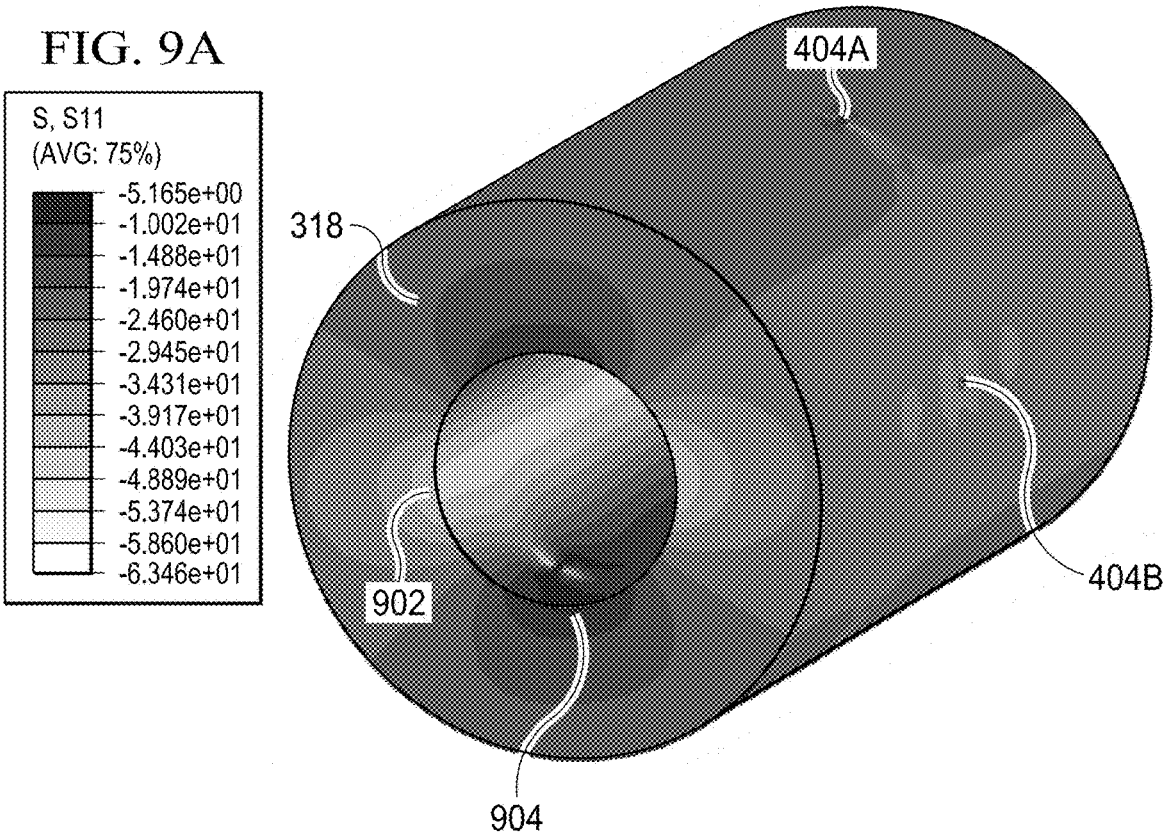
FIGS. 9A-9C are perspective views of the stress results of the finite element model at an internal pressure level representing the breakdown pressure.
Figure 9B:
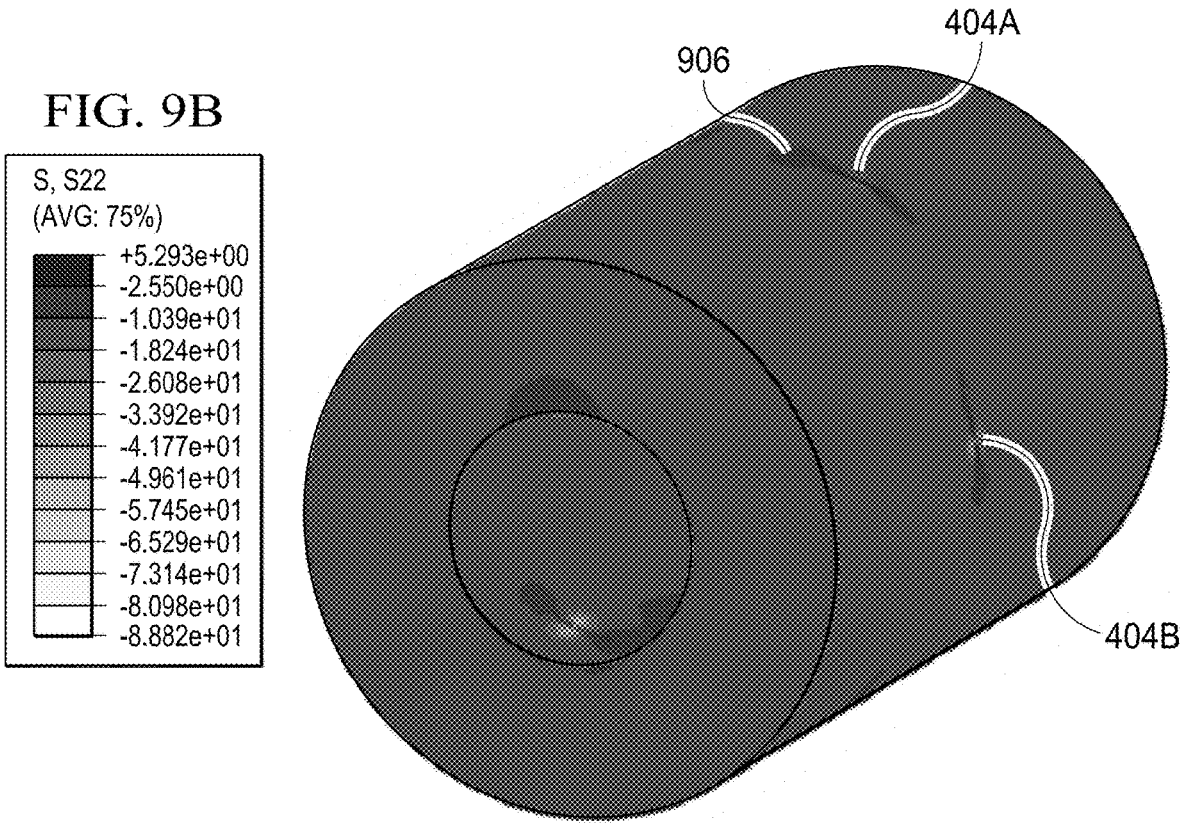
Figure 9C:
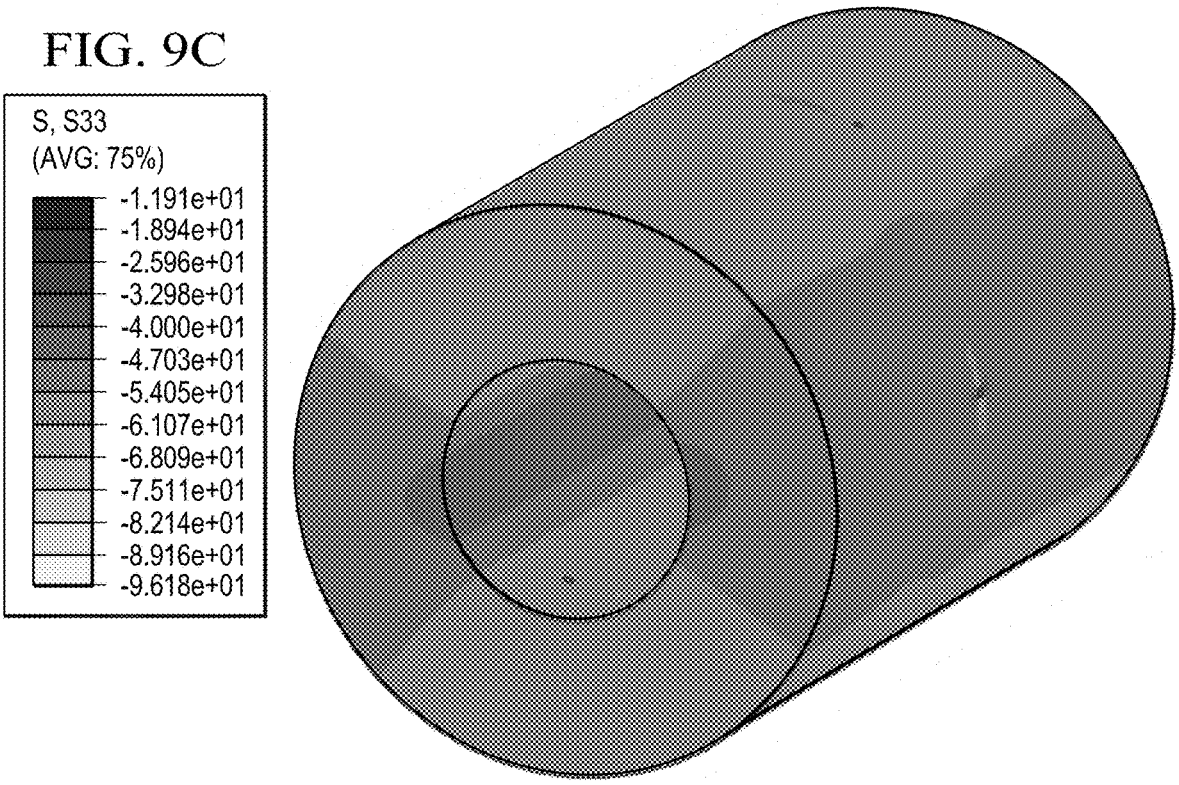

FIGS. 9A-9C are perspective views of the stress results of the finite element model 300 at an internal pressure level representing pressure breakdown. FIG. 9A is the $\sigma_{11}$ (S11) stress result, FIG. 9B is the $\sigma_{22}$ (S22) stress result, and FIG. 9C is the $\sigma_{33}$ (S33) stress result. The casing 314 is hidden from view. The rock 318 and the ends of the perforations tunnels 404 are shown. The stress contours represent the stress state in the rock 318.

Referring to FIG. 9A, S11 represents the $\sigma_{11}$ component of the Cauchy stress tensor $\sigma$. The $\sigma_{11}$ component is aligned with the "11" direction, which in this example represents the x-direction of the finite element model 300 (e.g., as shown in FIG. 3). In other words, the displayed contour results represent the stress component acting along a horizontal direction perpendicular to the longitudinal axis of the wellbore. The an components vary from a maximum compression of 63 MPa (negative means compression) around location 902 to a minimum compression of 5.2 MPa around location 904. In this example, all finite elements of the rock 318 have a $\sigma_{11}$ component representing compression at this applied pressure level.

Referring to FIG. 9B, S22 represents the $\sigma_{22}$ component of the Cauchy stress tensor $\sigma$. The $\sigma_{22}$ component is aligned with the "22" direction, which in this example represents the y-direction of the finite element model 300 (e.g., as shown in FIG. 3). In other words, the displayed contour results represent the stress component acting along the longitudinal axis of the wellbore. The $\sigma_{22}$ components vary from a maximum compression of 88 MPa (negative means compression) to a maximum tension of 5.2 MPa (positive means tension) around location 906 which is around the perforation tunnel 404A. In this example, a majority of finite elements of the rock 318 have a $\sigma_{22}$ component representing compression at this applied pressure level but some finite elements are in tension around the perforation tunnels 404. In this example, the $\sigma_{22}$ components are aligned with the directions of minimum horizontal stress of the wellbore.

In some examples, the Kirsch equations (Eqs. 6-7) are used to verify the finite element model 300. In some cases, perforation 404B will initiate fracture first in accordance with the Kirsch equations based on the in-situ stress orientation. The finite element model 300 results indicate that perforation 404B enters into tensile damage first, which is consistent with Kirsch equations.

Referring to FIG. 9C, S33 represents the $\sigma_{33}$ component of the Cauchy stress tensor $\sigma$. The $\sigma_{33}$ component is aligned with the "33" direction, which in this example represents the z-direction of the finite element model 300 (e.g., as shown in FIG. 3). In other words, the displayed contour results represent the stress component acting along the vertical axis (e.g., the direction that gravity acts). The $\sigma_{33}$ components vary from a maximum compression of 96 MPa to a minimum compression of 12 MPa In this example, all finite elements of the rock 318 have a $\sigma_{33}$ component representing compression at this applied pressure level.

Figure 10A:
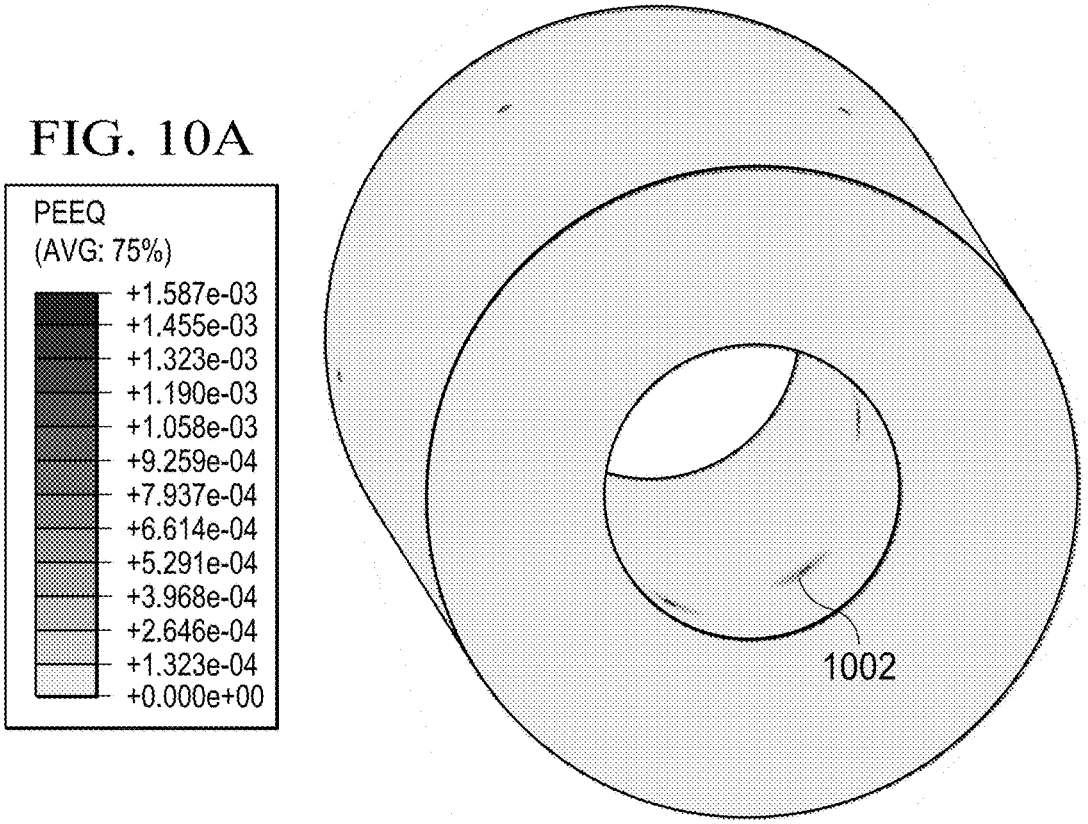
FIG. 10A is a perspective view of plastic strain PEEQ results of the finite element model at the internal pressure level representing the breakdown pressure.
Figure 10B:
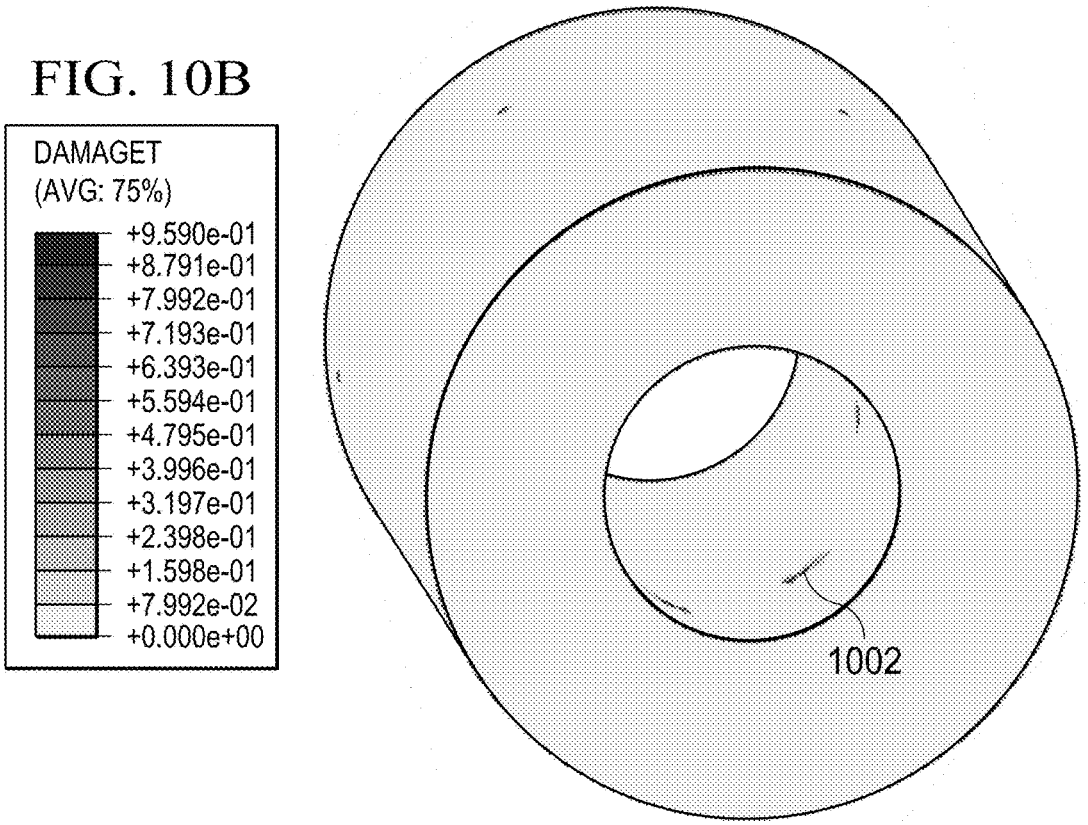
FIG. 10B is a perspective view of tensile damage DAMAGET results of the finite element model at the internal pressure level representing the breakdown pressure.
Figure 11A:
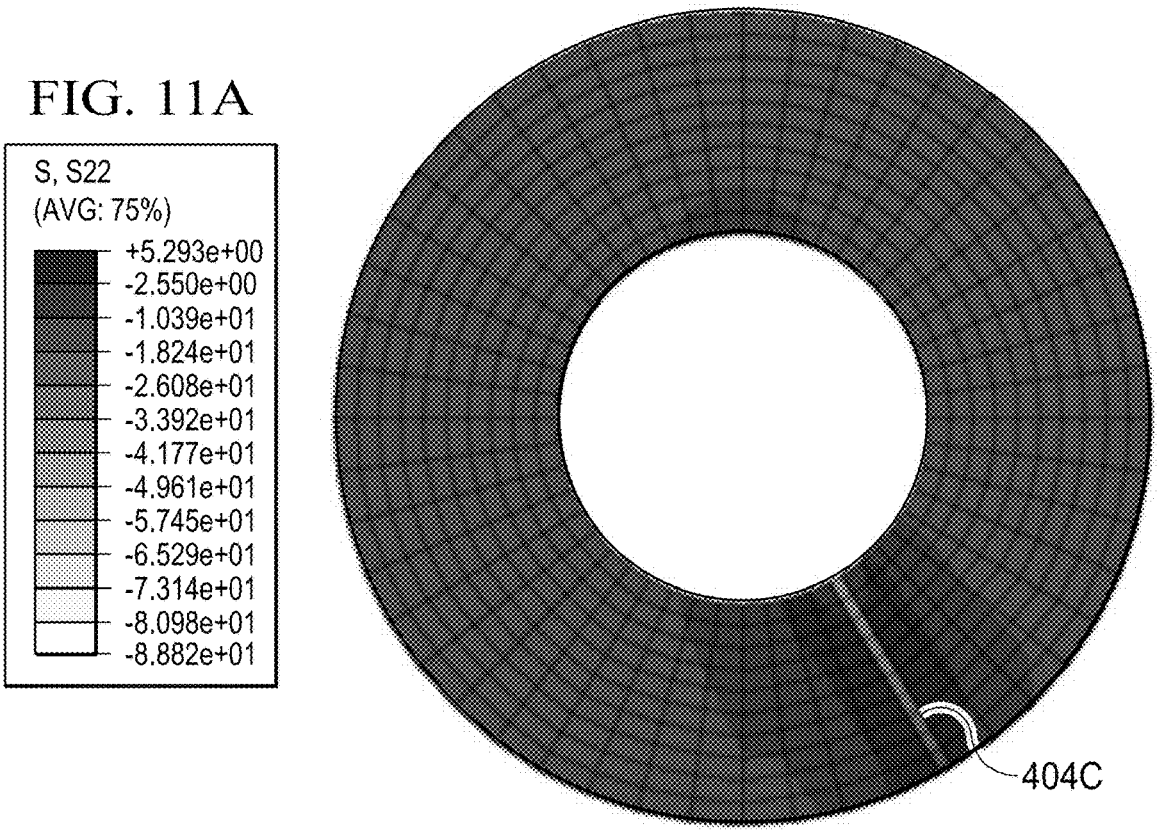
FIGS. 11A-11D are cross-section views of the stress S22 acting through the cross sections of perforations at the internal pressure level representing the breakdown pressure.
Figure 11B:
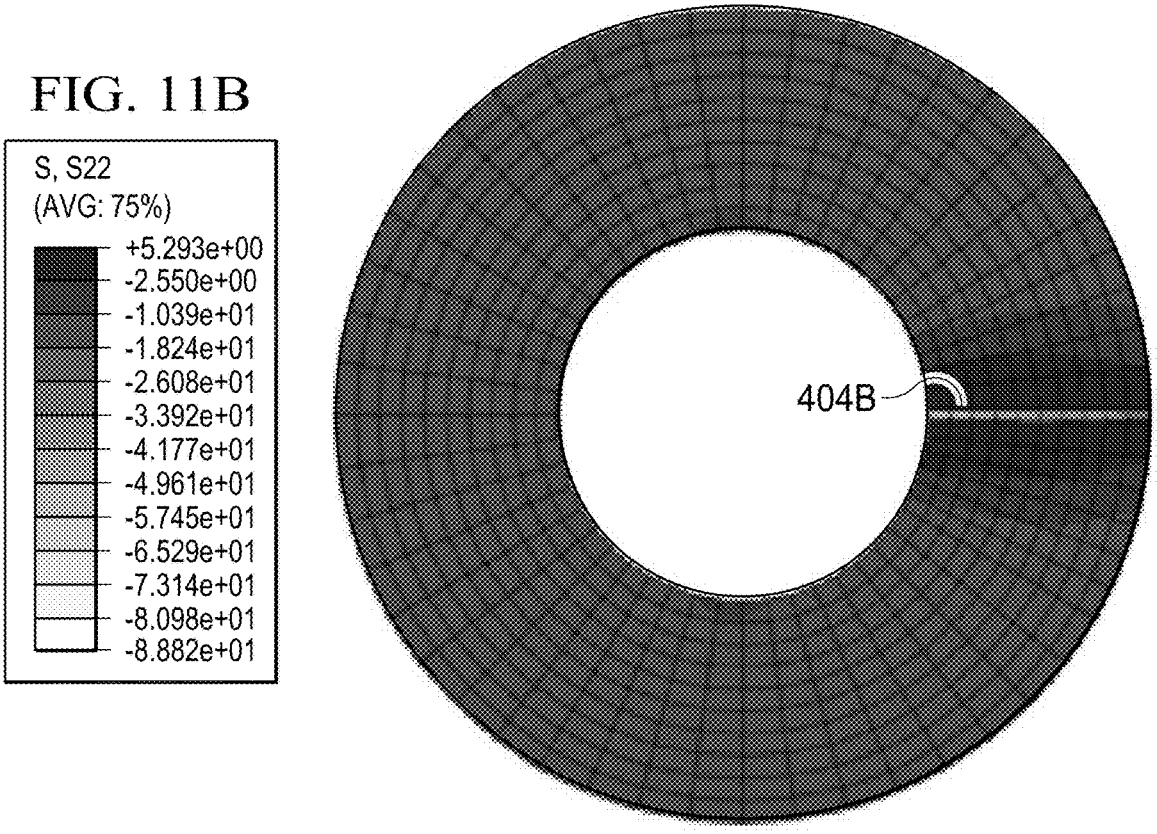
Figure 11C:
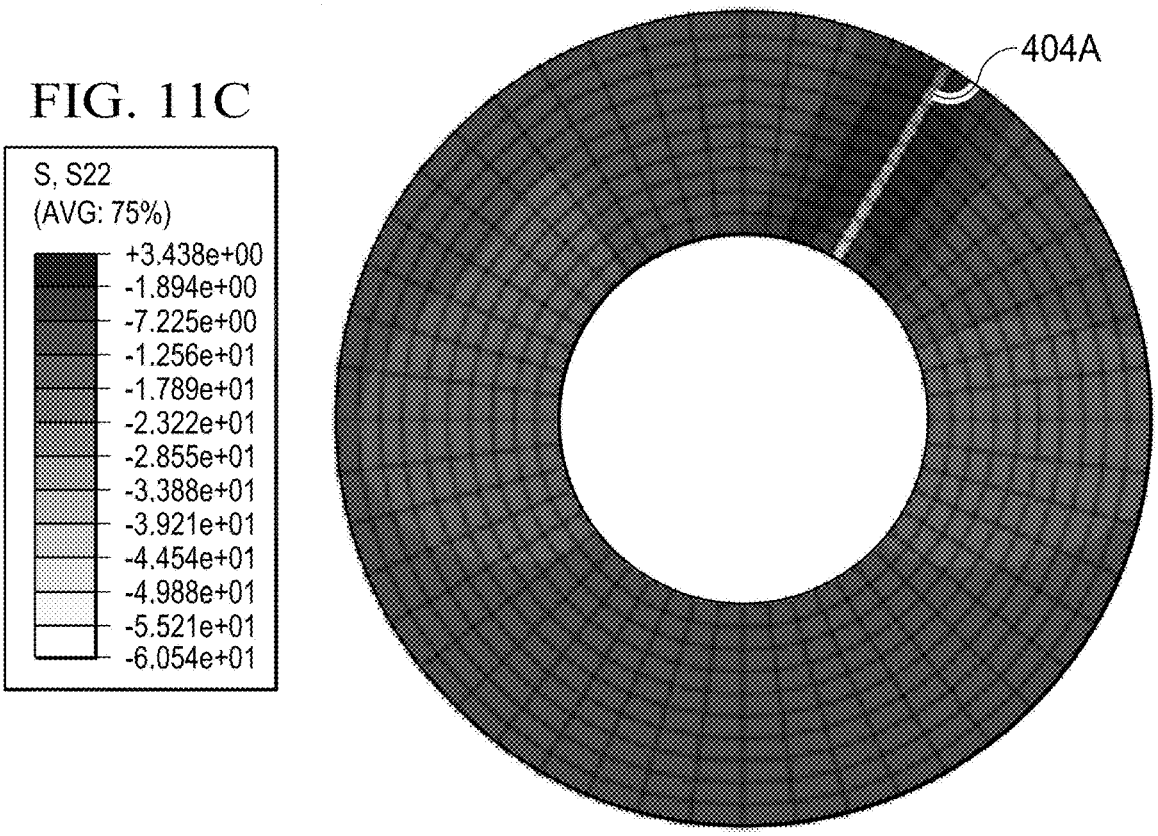
Figure 11D:
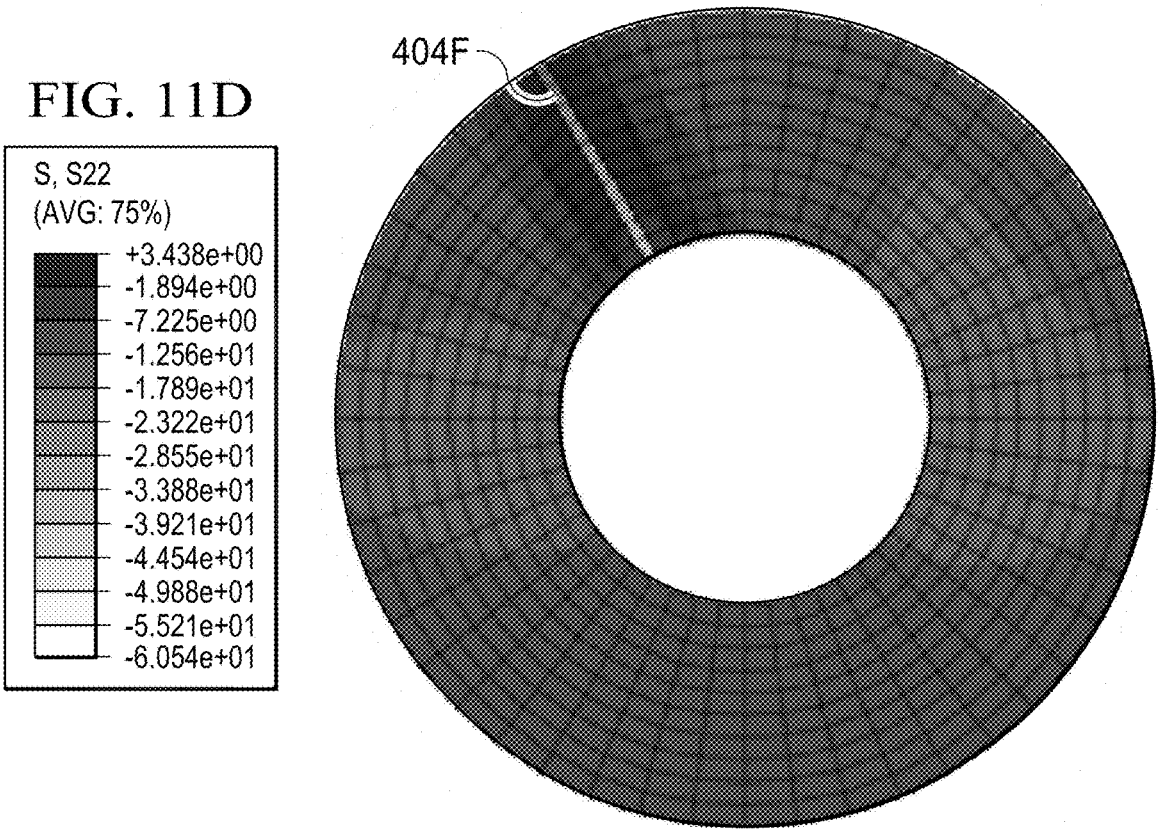
Figure 12A:
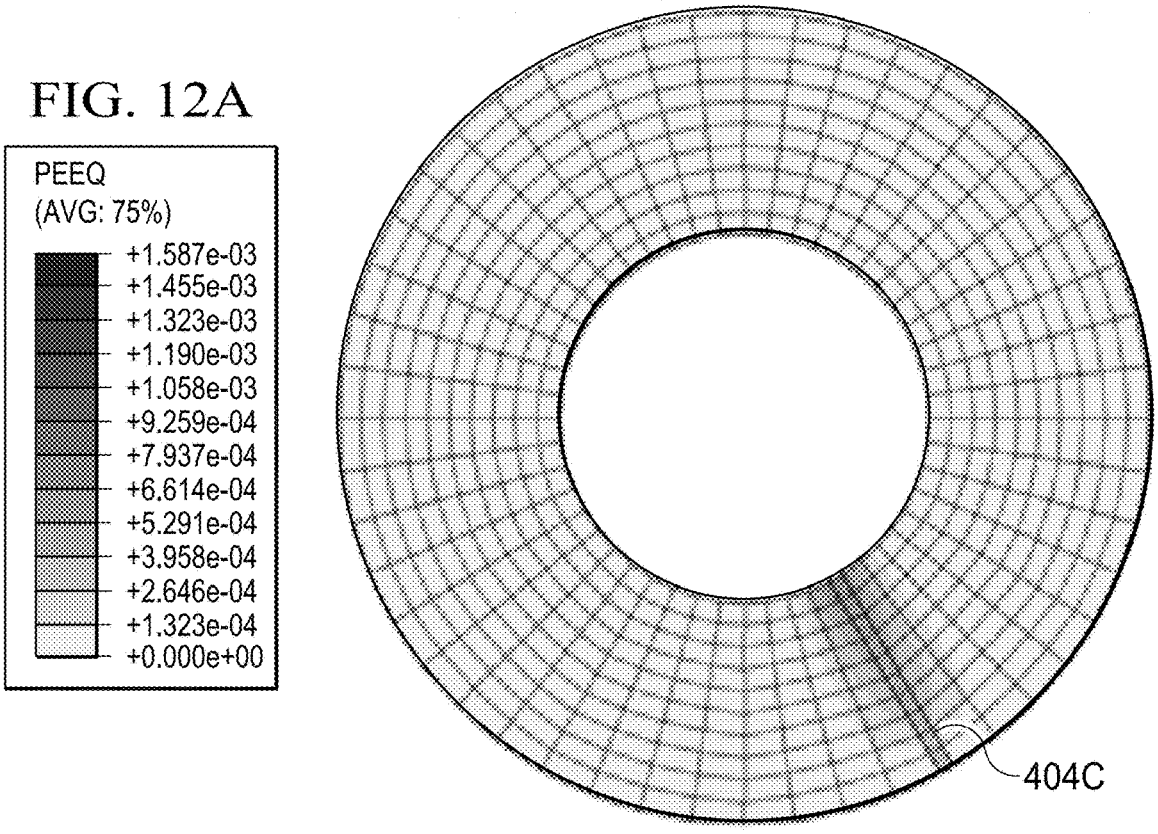
FIGS. 12A-12D are cross-section views of the plastic strain PEEQ acting through the cross sections of perforations at the internal pressure level representing the breakdown pressure.
Figure 12B:
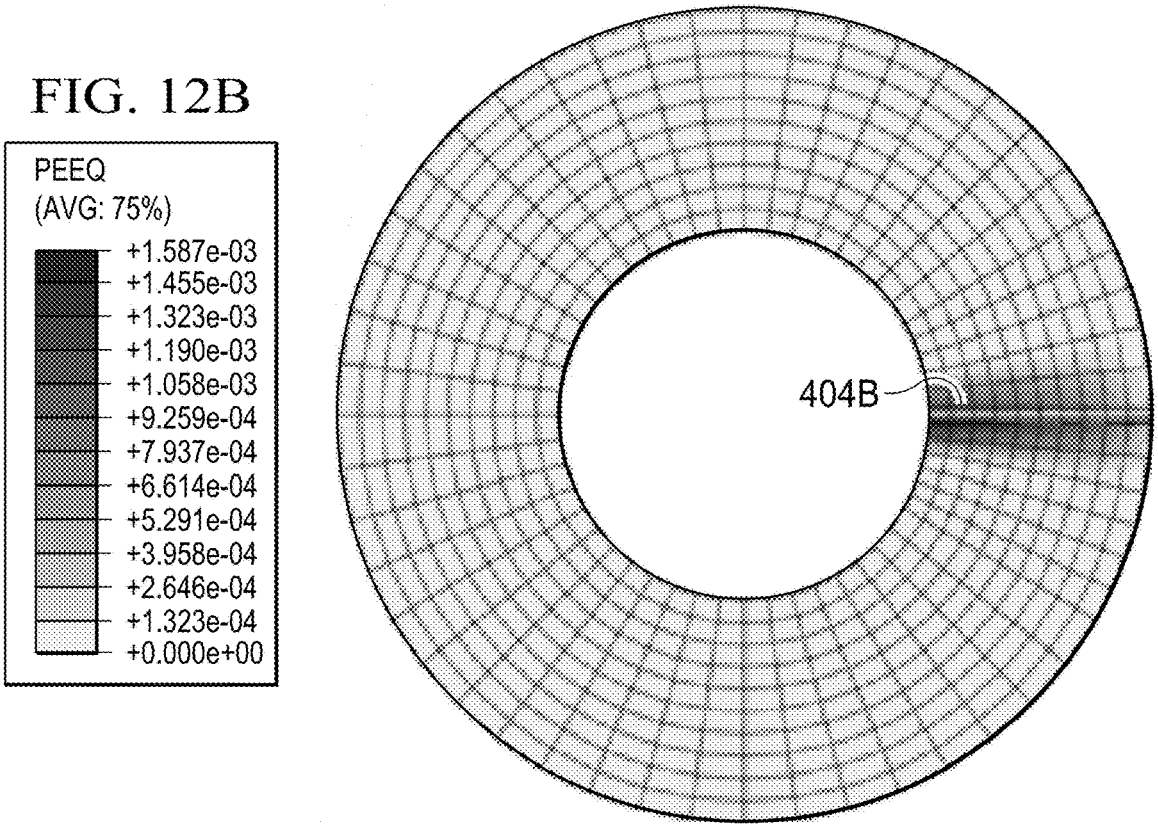
Figure 12C:
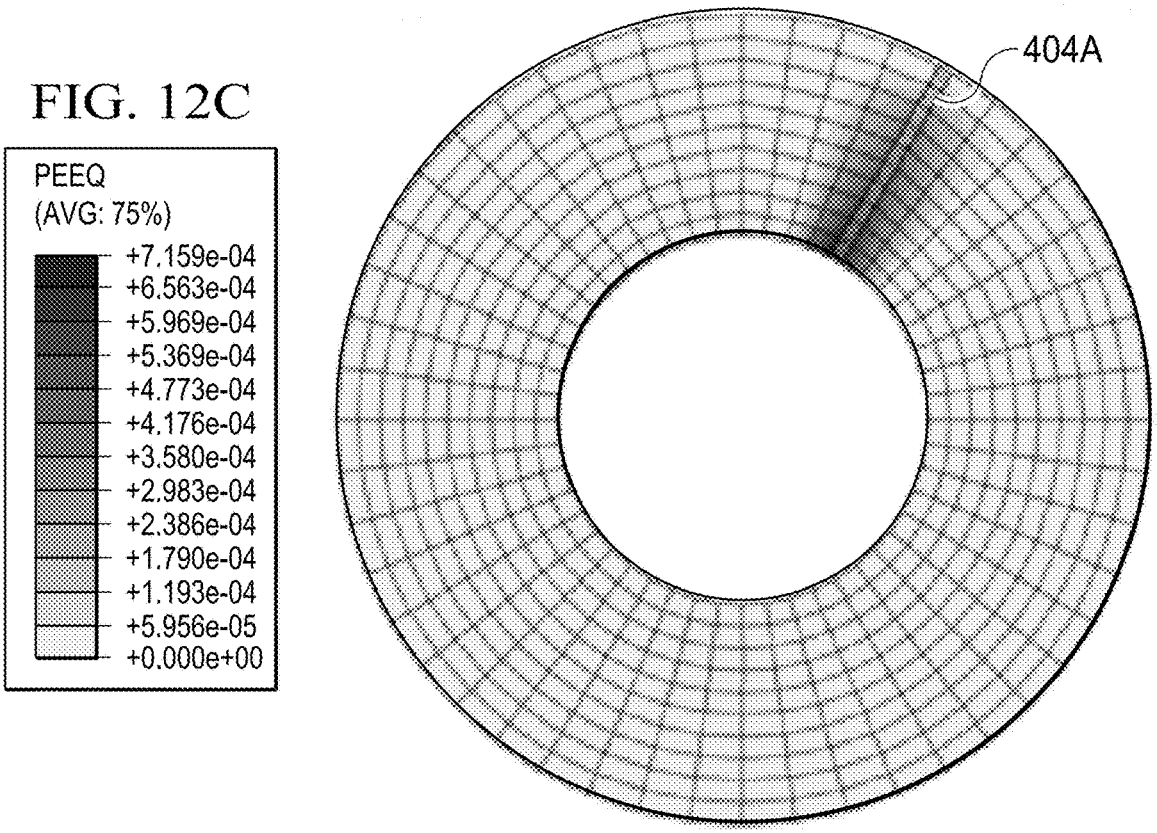
Figure 12D:
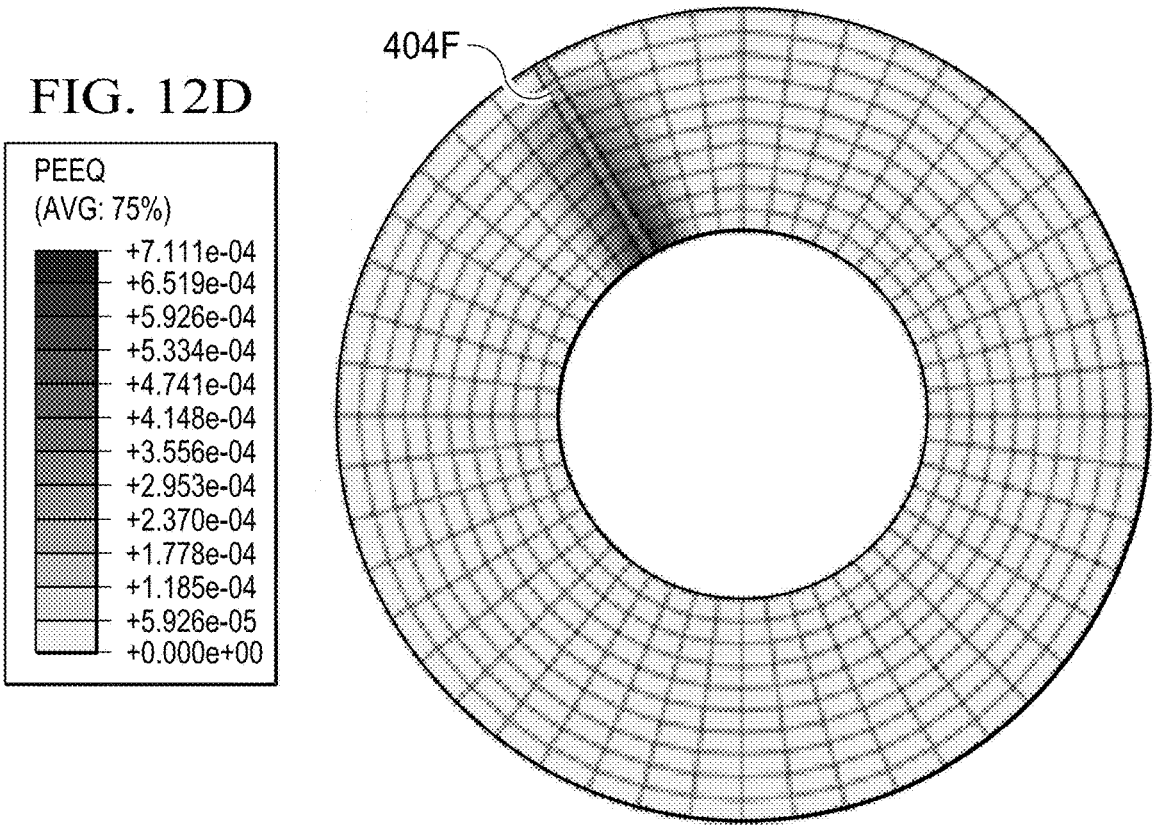

FIG. 10A is a perspective view of plastic strain (PEER) results and FIG. 10B is a perspective view of tensile damage (DAMAGET) results of the finite element model at the internal pressure level. The positive tensile stress of $\sigma_{22}$ in location 906 (shown in FIG. 9B) is also present in location 1002 which is also surrounding the perforations 402. In the example shown, locations 1002 exceed the in-situ stress $\sigma_{Hmin}$ and are very likely the tensile failure locations because the stress in the minimum horizontal stress direction changes from compression to tension. This change from compression to tension is an indication that the rock 318 is close to tensile failure. The tensile damage result of FIG. 10B confirms that location 1002 has accumulated damage. This means that transverse fractures will be initiated from the perforations 402 based on the orientation of the narrow tensile stress band under the loading of internal pressure from fluid injection. FIG. 10A shows the equivalent plastic strain occurs around the perforation cluster and the remainder of the rock 318 is still in elastic (i.e., not plastic). FIG. 10B indicates the tensile damage scalar due to fluid injection occurs in the surrounding area close to perforations 402 while the remainder of the rock 318 has no tensile damage (e.g., DAMAGET is zero).

In order to determine the breakdown pressure, the tensile damage occurring along the perforation tunnel 404 is determined from the simulation results. In this example, each perforation tunnel 404 has a different 3D orientation with respect to the in-situ stress orientations. This difference in orientation causes a variance in stress results around each perforation tunnel 404 which means that not all perforation tunnels 404 will have rock 318 surrounding the tunnel that fails at the breakdown pressure. The perforation tunnels 404 that develop tensile stress around the perforation tunnel 404 sufficient to cause enough damage to first reach a threshold of damage (e.g., 0.1, 0.2 as measured using simulation output variable DAMAGET) will define the breakdown pressure level. In cases with one than one perforation cluster 400, one perforation cluster may control the breakdown pressure of the wellbore (e.g., by reaching failure first) while the other perforation clusters do not.

FIGS. 11A-11D are cross-section views of the $\sigma_{22}$ component acting through cross sections of each of four perforations tunnels with at the internal pressure level. While only four perforations are shown in FIGS. 11A-11D, this because some of the perforation tunnels have stress results that are the same, or similar to, other perforation tunnels. Each of the perforation tunnels shown in FIGS. 11A-11D are oriented at a different angular phase angle and represent four sequential perforation angles. In this example, FIG. 11A corresponds to perforation tunnel 404C, FIG. 11B corresponds to perforation tunnel 404B, FIG. 11C corresponds to perforation tunnel 404A, and FIG. 11D corresponds to perforation tunnel 404F. The results of perforation tunnel 404D and 404E are substantially similar to the results shown in FIG. 11B and FIG. 11C, respectively. A positive tensile stress (e.g., positive S22 contour results) appears around the perforation tunnels representing the locations where hydraulic fracture initiation is likely to occur.

FIGS. 12A-12D are cross-section views of the plastic strain (PEEQ) acting through the cross sections of the perforations tunnels 404 at the internal pressure level. The cross section views of FIG. 12A-12D correspond to the respective cross section views of FIG. 11A-11D. The results indicate that plastic deformation (e.g., PEEQ greater than zero) occurs in the areas surrounding the perforation tunnels 404.

FIGS. 13A-13D are cross-section views of the damage (DAMAGET) acting through the cross sections of the perforations tunnels 404 at the internal pressure level. The cross section views of FIG. 13A-13D correspond to the respective cross section views of FIG. 11A-11D. The results indicate that damage (e.g., DAMAGET greater than zero) occurs in the areas surrounding the perforation tunnels 404.

Figure 13A:
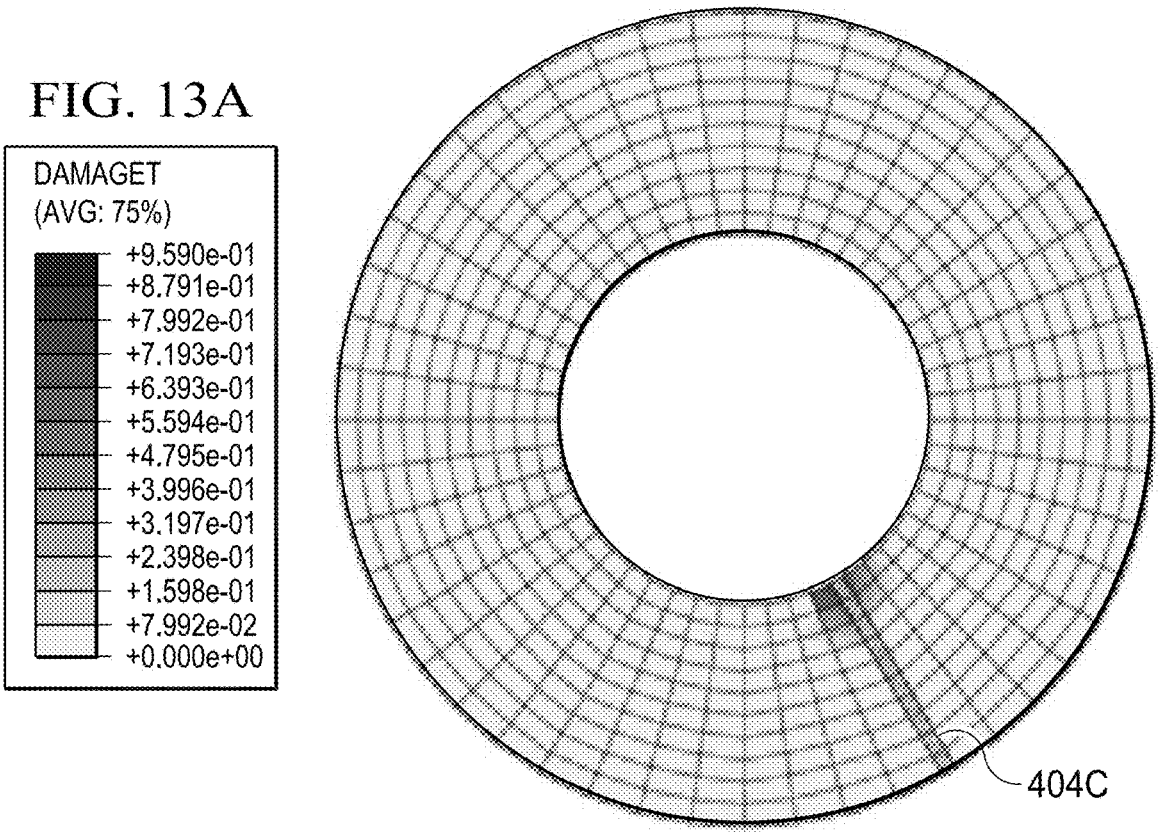
FIGS. 13A-13D are cross-section views of the tensile damage DAMAGET acting through the cross sections of perforations at the internal pressure level representing the breakdown pressure.

In this example, the damage associated with the perforation tunnel 404C (as shown in FIG. 13A) is 0.95 which is the largest of all the perforation tunnels 404. In this example, all four of the perforation tunnels 404 shown have rock 318 that has failed (e.g., when DAMAGET is greater than zero (or greater than a threshold, e.g., 0.2, 0.4, 0.6, etc.). In this example, if the threshold was set to 0.95, and the results from the previous increment of the load step resulted in damage values less than 0.95 around each of the six perforation tunnels 404, then the breakdown pressure would be determined based on the applied pressure for this increment since perforation tunnels 404C and 404B have exceeded the damage threshold. In this example, the breakdown pressure is obtained from FIG. 14. Tensile rock failure is at a pseudo load time around 0.6 corresponding to a breakdown pressure of around 15,000 psi.

Figure 13B:
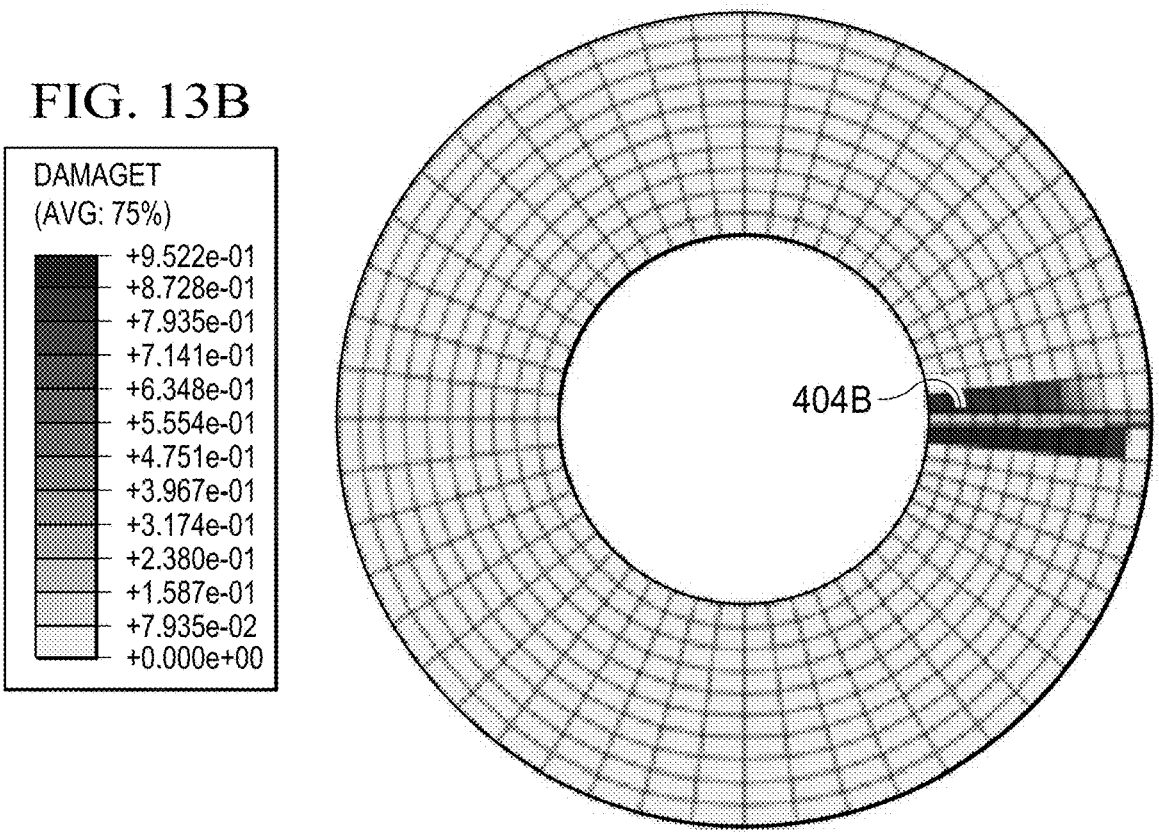
Figure 13C:
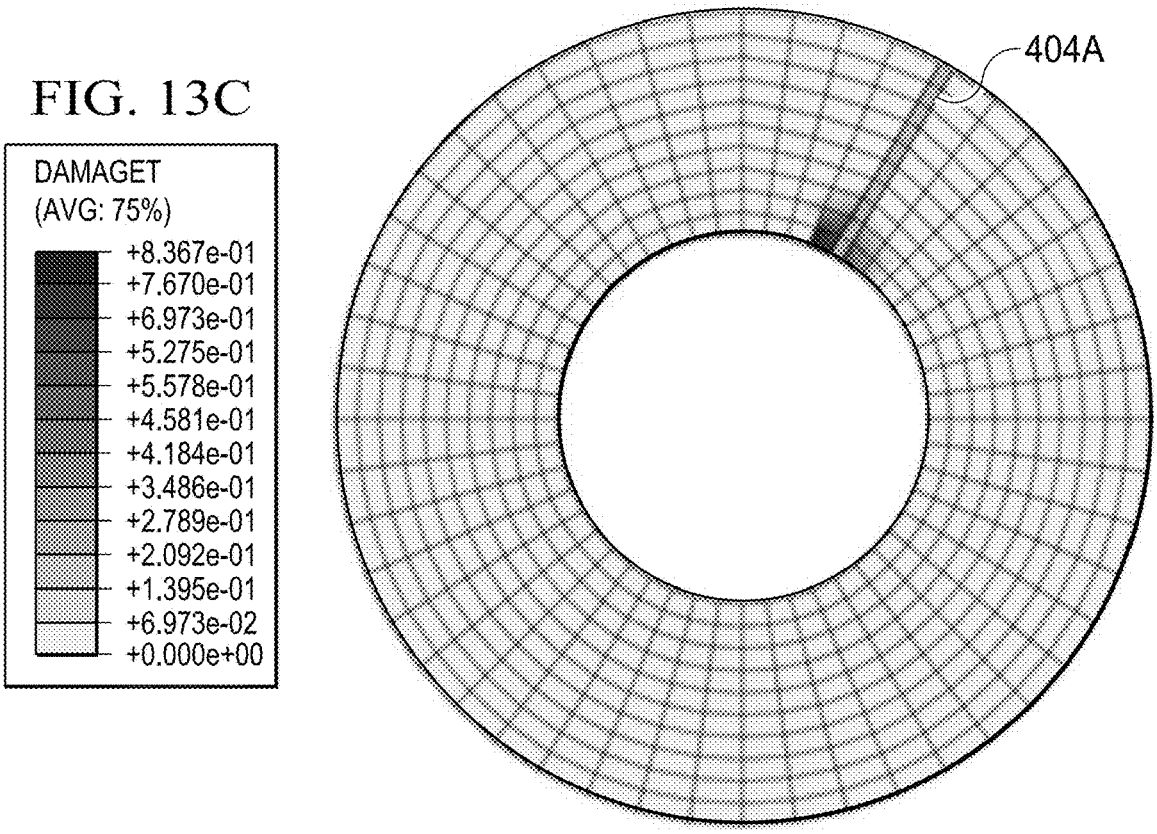
Figure 13D:
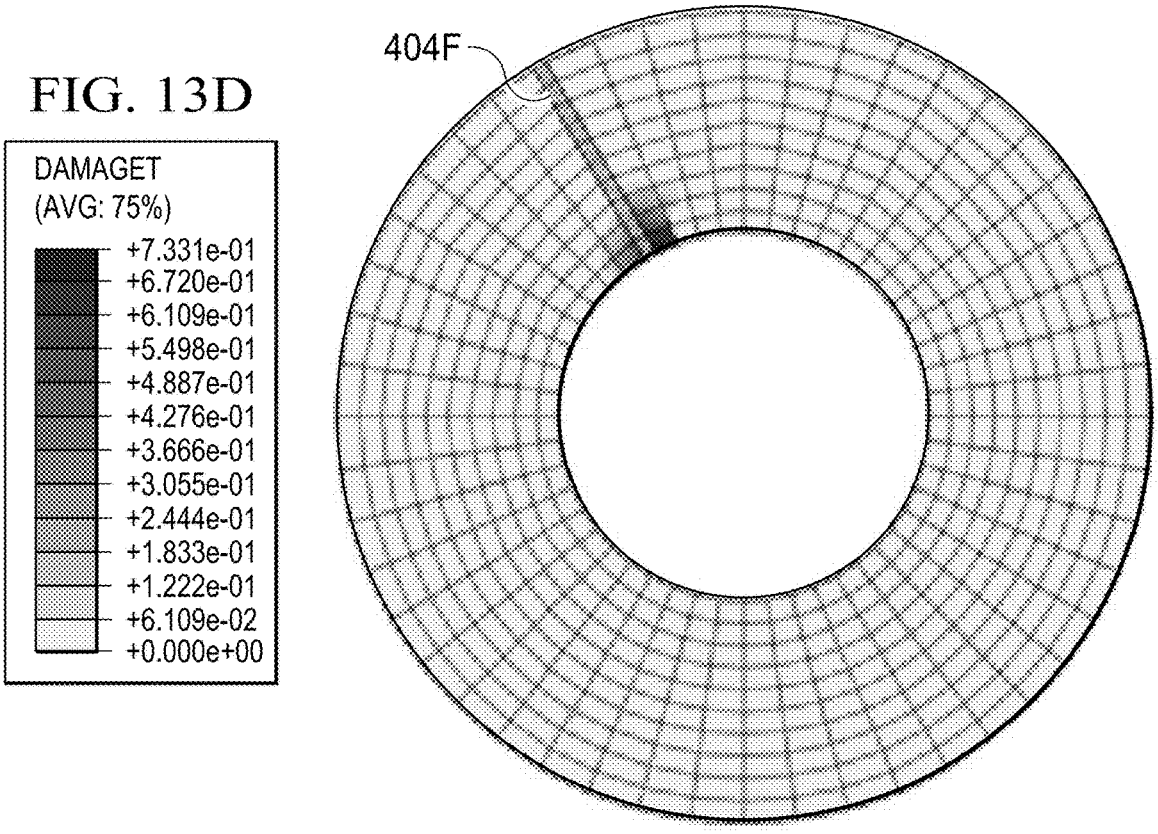

FIG. 13B shows that, among the four perforations tunnels, the horizontal perforation tunnel has the most number of finite elements with damage for the pressure level. The perforation cluster of FIG. 13B is the first one to develop tensile damage for this in-situ stresses setting. This is expected based on the Kirsch equation and the perforation orientation. The overall breakdown pressure for this wellbore will be limited by this horizontal perforation tunnel 404B since it is the first one to initiate fracture.

In some cases, the finite element model 300 includes more than one perforation cluster, In this scenario, the breakdown pressure is determined when one perforation tunnel develops tensile damage above a threshold damage among all the perforation clusters.

Methods of Modeling Workflows

Figure 15:
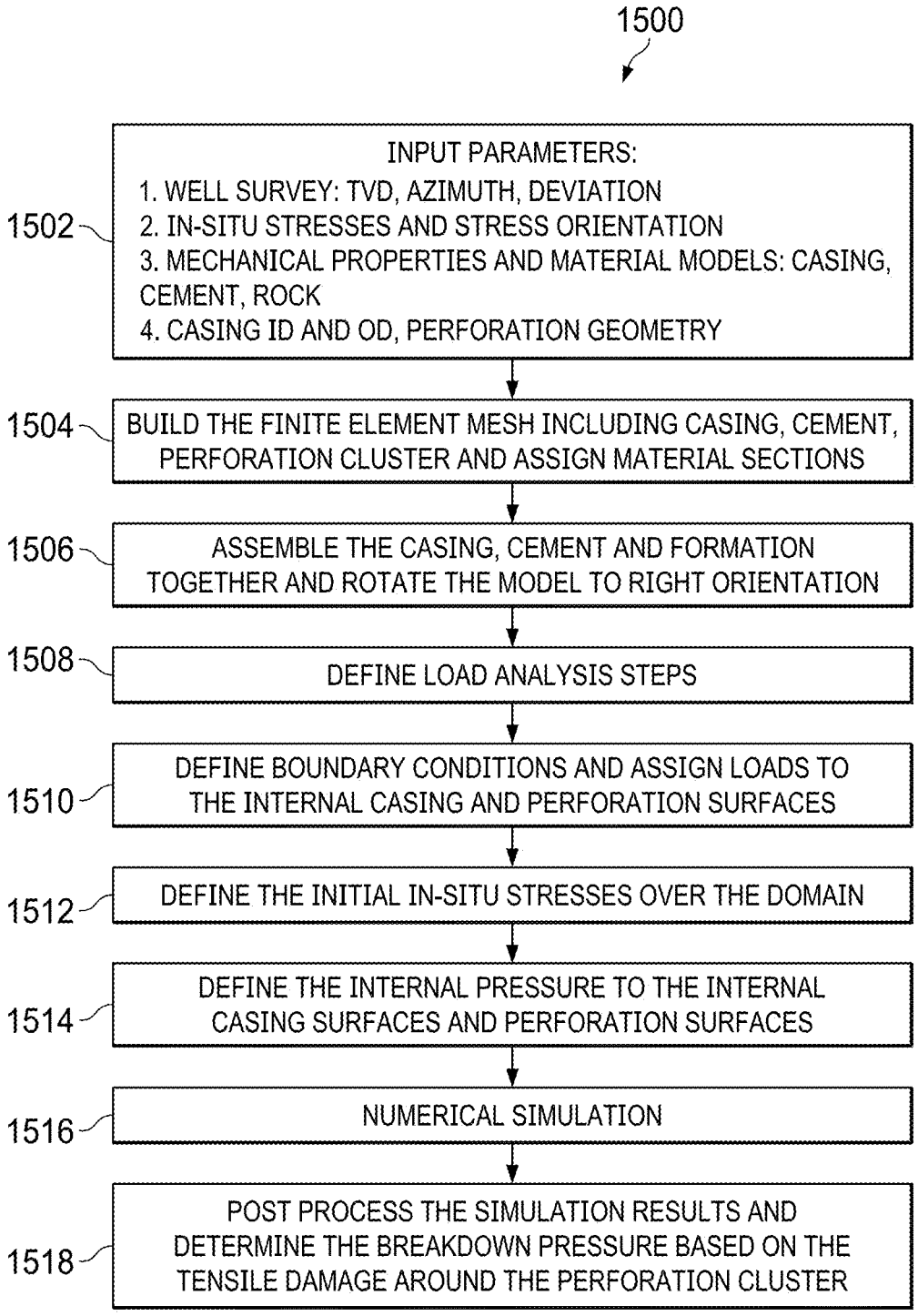
FIG. 15 is a flowchart of a modeling method for predicting breakdown pressure for perforation hydraulic fracturing treatment.

FIG. 15 is a flowchart of a modeling method 1500 for predicting breakdown pressure for hydraulic fracturing a subsurface formation. Input parameters s are determined 1502 that include a well survey to locate wellbore in the model and sonic log data to calculate the mechanical properties, model parameters, and in-situ stresses and orientation.

The finite element model is built 1504 by developing geometric models of the casing, the cement, and the formation. Corresponding material models are assigned. Based on the in-situ stresses orientation, well landing depth, and the domain used for the finite element modeling, the model including the casing, cement and one or more perforation clusters is assembled 1506 and rotated to the correct orientation based on borehole image log processing (e.g., aligned with the orientations according to image log data). The in-situ stress direction is obtained for a particular formation from the image log (e.g., identifying breakout and breakdown in image log). The finite element model is rotated so that the well trajectory orientation and in-situ stress orientation are correctly aligned in the modeling. For example, when the perforations are aligned in the maximum horizontal in-situ stress direction, the rock 318 will initiate fracture at the lowest breakdown pressure compared to aligning the perforations at a different angle.

The load analysis steps are defined 1508. The corresponding boundary conditions and loads are defined 1512 over the domain. The internal pressure is applied 1514 to the internal casing surfaces and the perforation surfaces. The numerical simulation is solved 1516 and post processed to determine 1518 the breakdown pressure based on the tensile damage developing around each the perforation cluster.

FIG. 16 is a flowchart of an alternate modeling method 1600 for predicting breakdown pressure for hydraulic fracturing a subsurface formation. The method 1600 includes implementing 1602 a three-dimensional finite element model on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing.

The method 1600 includes assigning 1604 a concrete damage plasticity model to define constitutive behavior of the rock of the subsurface formation, the concrete damage plasticity model including compression hardening, compression damage, tensile stiffening, and tensile damage behavior. A contact relationship is assigned 1606 at an interface between the casing and the cement, the contact relationship modeling de-bonding of the interface between the casing and the cement.

The method 1600 includes solving 1608 the three-dimensional finite element model on the one or more processors to determine a breakdown pressure of the deviated well based on an amount of tensile damage of the rock based on an applied pressure representing injected hydraulic fluid and the assigned concrete damage plasticity model and the assigned contact relationship.

In some implementations, the method 1600 includes drilling and completing a deviated well with a wellbore casing size, tubing size, and wellhead selected at least in part based on the determined breakdown pressure. In some implementations, the method 1600 includes selecting a wellbore casing size, a tubing size, and wellhead at least in part based on the determined breakdown pressure.

In some implementations, the method 1600 includes injecting hydraulic fluid into the deviated well at an injection pressure that represents the required breakdown pressure to cause hydraulic fracturing of the rock of the subsurface formation. In this scenario, the injection pressure is determined based on the breakdown pressure determined from the finite element model. In some implementations, injecting hydraulic fluid into the deviated well includes pumping the hydraulic fluid into the deviated well using a pump schedule determined at least in part based on the determined breakdown pressure. In some cases, the method 1600 includes determining the pump schedule of a pump for injecting the hydraulic fluid into the wellbore at least in part based on the determined breakdown pressure.

Figure 17:
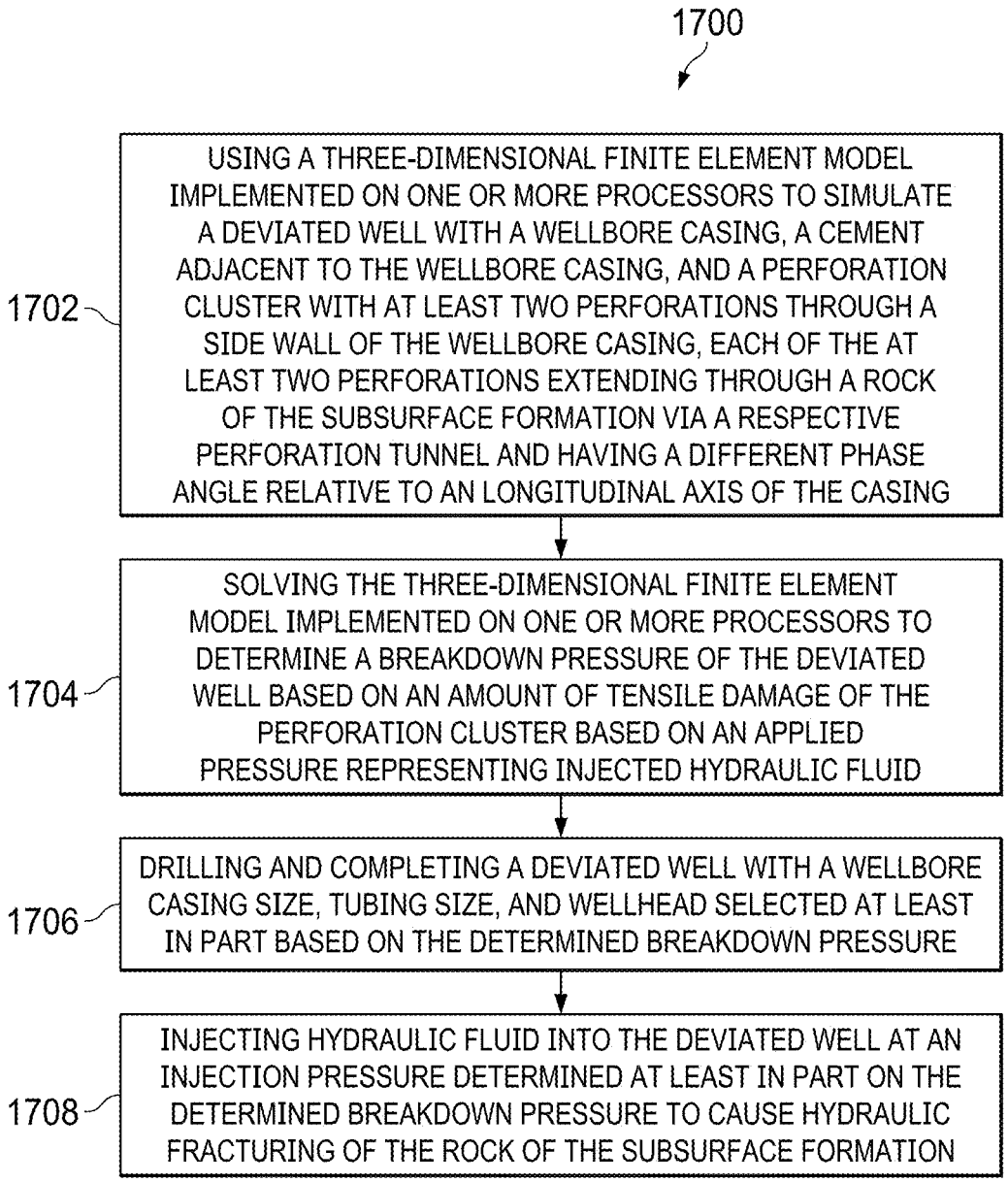
FIG. 17 is a flowchart of an alternate modeling method for predicting breakdown pressure for perforation hydraulic fracturing treatment.

FIG. 17 is a flowchart of an alternate modeling method 1700 for predicting breakdown pressure for hydraulic fracturing a subsurface formation. The method 1700 includes using 1702 a three-dimensional finite element model implemented on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing.

The method 1700 includes solving 1704 the three-dimensional finite element model implemented on one or more processors to determine a breakdown pressure of the deviated well based on an amount of tensile damage of the perforation cluster induced by an applied pressure representing injected hydraulic fluid.

The method 1700 includes drilling and completing 1706 a deviated well with a wellbore casing size, tubing size, and wellhead selected at least in part based on the determined breakdown pressure.

The method 1700 includes injecting 1708 hydraulic fluid into the deviated well at an injection pressure determined at least in part on the determined breakdown pressure to cause hydraulic fracturing of the rock of the subsurface formation. In some implementations, injecting hydraulic fluid into the deviated well comprises pumping the hydraulic fluid into the deviated well using a pump schedule determined at least in part based on the determined breakdown pressure.

In some implementations, methods 1600, 1700 include extracting material properties of the rock from log data and/or lab test data. In some cases, the compression hardening, compression damage, tensile stiffening, and tensile damage behavior of the concrete damage plasticity model of the rock are at least in part based on the extracted material properties from lab test data.

In some implementations, methods 1600, 1700 include rotating an orientation of the finite element model based on borehole image log data so that a well trajectory orientation and in-situ stresses are oriented over a domain of the finite element model in accordance with the borehole image log data. In some cases, the in-situ stress are defined based on a maximum horizontal stress direction of the borehole image log data.

In some implementations, each of the at least two perforations are axially spaced relative to each other. In some cases, each of the at least two perforations are angularly spaced relative to each other around a circumference of the wellbore. In some cases, the at least two perforations are six perforations equally spaced and located within a 20 centimeter length of the wellbore casing and angularly spaced 60 degrees apart.

In some implementations, an output of the solved three-dimensional finite element model is a spatially varying contour of the tensile damage of the rock. In some implementations, determining the breakdown pressure includes detecting when at least one finite element representing the rock has a tensile failure above a predetermined threshold. In some cases, the predetermined threshold is a scalar between 0.0 and 0.2, between 0.0 and 0.4, between 0.0 and 0.6, between 0.0 and 0.8, or between 0.0 and 1.0.

In some implementations, a portion of the deviated well has a deviated angle of at least 10 degrees relative to a normal direction from a ground surface.

In some implementations, solving the three-dimensional finite element model includes solving the three-dimensional finite element model using two quasi-static loading steps, a first step used for solving static equilibrium with a loading of in-situ stresses, gravity loading, overburden, and underburden, and a second step used for solving static equilibrium of an applied pressure to determine the breakdown pressure while including the loading of the first step.

In some implementations, the three-dimensional finite element model includes a concrete damage plasticity model representing constitutive behavior of the rock and a contact relationship between an interface of the wellbore casing and the cement adjacent to the casing, the contact relationship modeling de-bonding of the interface of the casing and the cement.

Figure 18:
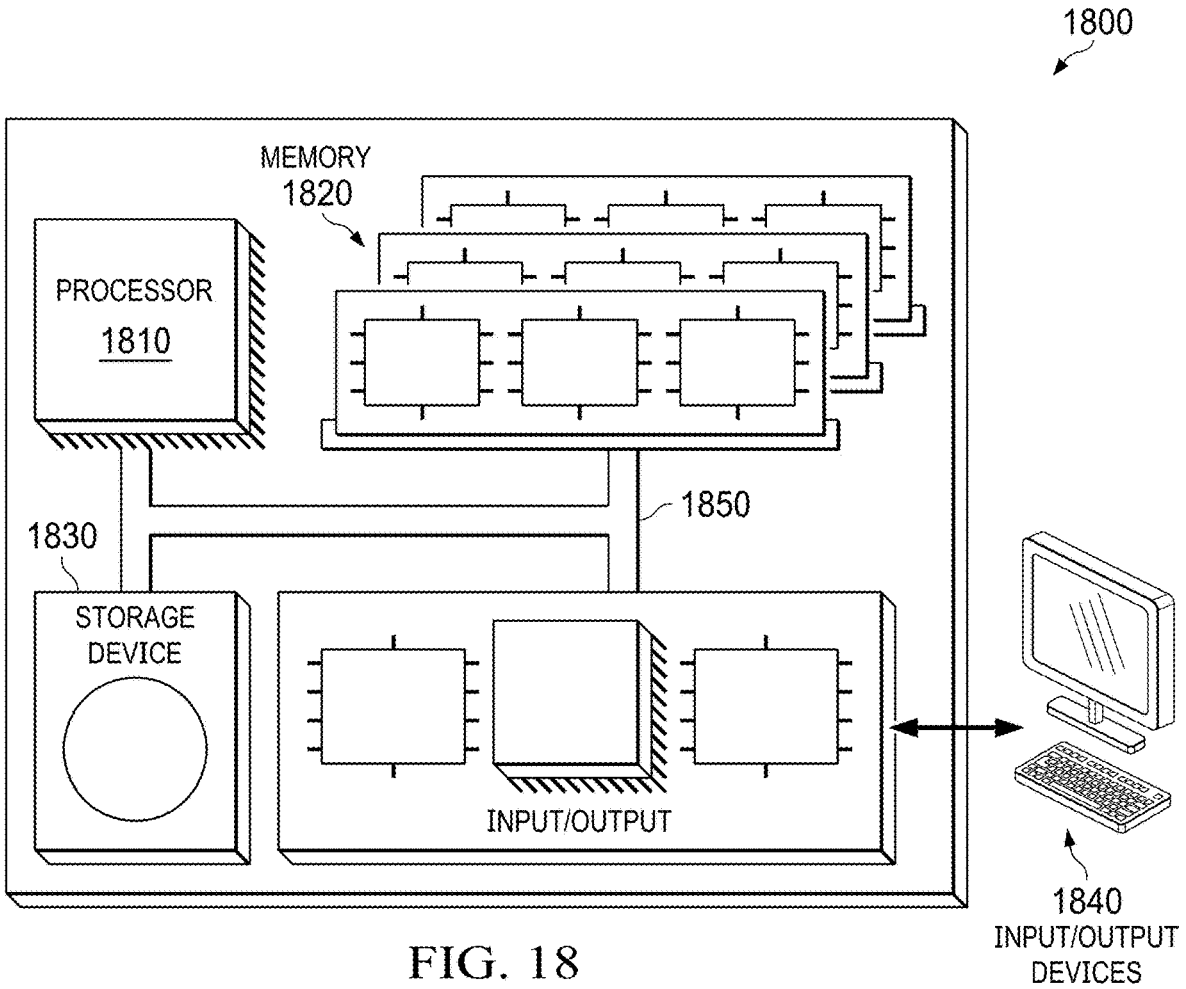
FIG. 18 is a schematic illustration of an example controller for determining a subterranean formation breakdown pressure Like reference symbols in the various drawings indicate like elements.

FIG. 18 is a schematic illustration of an example controller 1800 (or control system) for determining a subterranean formation breakdown pressure according to the present disclosure. For example, the controller 1800 may include or be part of the control system 146 shown in FIG. 1. The controller 1800 is intended to include various forms of digital computers, such as printed circuit boards (PCB), processors, digital circuitry, or otherwise parts of a system for determining a subterranean formation breakdown pressure. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 1800 includes a processor 1810, a memory 1820, a storage device 1830, and an input/output device 1840 (for displays, input devices, example, sensors, valves, pumps). Each of the components 1810, 1820, 1830, and 1840 are interconnected using a system bus 1850. The processor 1810 is capable of processing instructions for execution within the controller 1800. The processor may be designed using any of a number of architectures. For example, the processor 1810 may be a CISC (Complex Instruction Set Computers) processor, a RISC (Reduced Instruction Set Computer) processor, or a MISC (Minimal Instruction Set Computer) processor.

In one implementation, the processor 1810 is a single-threaded processor. In another implementation, the processor 1810 is a multi-threaded processor. The processor 1810 is capable of processing instructions stored in the memory 1820 or on the storage device 1830 to display graphical information for a user interface on the input/output device 1840.

The memory 1820 stores information within the controller 1800. In one implementation, the memory 1820 is a computer-readable medium. In one implementation, the memory 1820 is a volatile memory unit. In another implementation, the memory 1820 is a non-volatile memory unit.

The storage device 1830 is capable of providing mass storage for the controller 1800. In one implementation, the storage device 1830 is a computer-readable medium. In various different implementations, the storage device 1830 may be a floppy disk device, a hard disk device, an optical disk device, or a tape device.

The input/output device 1840 provides input/output operations for the controller 1800. In one implementation, the input/output device 1840 includes a keyboard and/or pointing device. In another implementation, the input/output device 1840 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method of hydraulic fracturing a subsurface formation, the method comprising:

using a three-dimensional finite element model implemented on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing;

solving the three-dimensional finite element model implemented on one or more processors to determine a breakdown pressure of the deviated well based on an amount of tensile damage of the perforation cluster induced by an applied pressure representing injected hydraulic fluid;

drilling and completing a deviated well with a wellbore casing size, tubing size, and wellhead selected at least in part based on the determined breakdown pressure; and injecting hydraulic fluid into the deviated well at an injection pressure determined at least in part on the determined breakdown pressure to cause hydraulic fracturing of the rock of the subsurface formation, wherein the three-dimensional finite element model includes a concrete damage plasticity model representing constitutive behavior of the rock and a contact relationship between an interface of the wellbore casing and the cement adjacent to the casing, the contact relationship modeling de-bonding of the interface of the casing and the cement.

2. The method of claim 1, further comprising extracting material properties of the rock from log data and/or lab test data, wherein the concrete damage plasticity model includes compression hardening, compression damage, tensile stiffening, and tensile damage behavior at least in part based on the extracted material properties.

3. The method of claim 1, wherein injecting hydraulic fluid into the deviated well comprises pumping the hydraulic fluid into the deviated well using a hydraulic fracturing pump schedule determined at least in part based on the determined breakdown pressure.

4. The method of claim 1, wherein each of the at least two perforations are axially spaced relative to each other and each of the at least two perforations are angularly spaced relative to each other around a circumference of the wellbore.

5. The method of claim 4, wherein the at least two perforations are six perforations located within a 20 centimeter length of the wellbore casing and angularly spaced 60 degrees apart.

6. The method of claim 1, wherein determining the breakdown pressure comprises detecting when at least one finite element representing the rock has a tensile failure above a predetermined threshold.

7. The method of claim 6, wherein the predetermined threshold is a scalar between 0.0 and 0.2.

8. The method of claim 1, wherein solving the three-dimensional finite element model comprises solving the three-dimensional finite element model using two quasi-static loading steps, a first step used for solving static equilibrium with a loading of in-situ stresses, gravity loading, overburden, and underburden, and a second step used for solving static equilibrium of an applied pressure to determine the breakdown pressure while including the loading of the first step.

9. The method of claim 1, further comprising rotating an orientation of the three-dimensional finite element model based on borehole image log data so that a well trajectory orientation and in-situ stresses are oriented in accordance with the borehole image log data.

10. A method of hydraulic fracturing a subsurface formation, the method comprising:

implementing a three-dimensional finite element model on one or more processors to simulate a deviated well with a wellbore casing, a cement adjacent to the wellbore casing, and a perforation cluster with at least two perforations through a side wall of the wellbore casing, each of the at least two perforations extending through a rock of the subsurface formation via a respective perforation tunnel and having a different phase angle relative to an longitudinal axis of the casing;

assigning a concrete damage plasticity model to define constitutive behavior of the rock of the subsurface formation, the concrete damage plasticity model including compression hardening, compression damage, tensile stiffening, and tensile damage behavior;

assigning a contact relationship at an interface between the casing and the cement, the contact relationship modeling de-bonding of the interface between the casing and the cement; and solving the three-dimensional finite element model on the one or more processors to determine a breakdown pressure of the deviated well based on an amount of tensile damage of the rock induced by an applied pressure representing injected hydraulic fluid and the assigned concrete damage plasticity model and the assigned contact relationship.

11. The method of claim 10, further comprising extracting material properties of the rock from log data and/or lab test data, wherein the compression hardening, compression damage, tensile stiffening, and tensile damage behavior of the concrete damage plasticity model of the rock are at least in part based on the extracted material properties.

12. The method of claim 10, further comprising rotating an orientation of the three-dimensional finite element model based on borehole image log data so that a well trajectory orientation and in-situ stresses are oriented in accordance with the borehole image log data.

13. The method of claim 10, wherein each of the at least two perforations are axially spaced relative to each other and angularly spaced relative to each other around a circumference of the wellbore.

14. The method of claim 13, wherein the at least two perforations are six perforations located within a 20 centimeter length of the wellbore casing and angularly spaced 60 degrees apart.

15. The method of claim 10, wherein an output of the solved three-dimensional finite element model is a spatially varying contour of the tensile damage of the rock.

16. The method of claim 10, wherein determining the breakdown pressure comprises detecting when at least one finite element representing the rock has a tensile failure above a predetermined threshold.

17. The method of claim 16, wherein the predetermined threshold is a scalar between 0.0 and 0.2.

18. The method of claim 10, wherein a portion of the deviated well has a deviated angle of at least 10 degrees relative to a normal direction from a ground surface.

19. The method of claim 10, further comprising selecting a wellbore casing size, a tubing size, and wellhead at least in part based on the determined breakdown pressure.

20. The method of claim 19, further comprising determining a hydraulic fracturing pump schedule for injecting hydraulic fluid into the wellbore at least in part based on the determined breakdown pressure.

* * * * *